US008063571B2

(12) United States Patent
Yang

(10) Patent No.: US 8,063,571 B2
(45) **Date of Patent: *Nov. 22, 2011**

(54) BI-DIRECTIONAL LIGHT EMITTING DIODE DRIVE CIRCUIT IN BI-DIRECTIONAL DIVIDED POWER IMPEDANCE

(76) Inventor: Tai-Her Yang, Dzan-Hwa (TW)

( * ) Notice: Subject to any disclaimer, the term of this patent is extended or adjusted under 35 U.S.C. 154(b) by 359 days.

This patent is subject to a terminal disclaimer.

(21) Appl. No.: 12/351,927

(22) Filed: Jan. 12, 2009

(65) Prior Publication Data

US 2009/0179579 A1 Jul. 16, 2009

Related U.S. Application Data

(60) Provisional application No. 61/020,836, filed on Jan. 14, 2008.

(51) Int. Cl.

| | |
|---|---|
| ***H05B 37/02*** | (2006.01) |
| ***H05B 39/04*** | (2006.01) |
| ***H05B 41/36*** | (2006.01) |

(52) U.S. Cl. ..... 315/224; 315/223; 315/209 R; 315/291

(58) Field of Classification Search ..... None
See application file for complete search history.

(56) References Cited

U.S. PATENT DOCUMENTS 6,411,045 B1 * 6/2002 Nerone ..... 315/291

* cited by examiner

*Primary Examiner* — Anh Tran
(74) *Attorney, Agent, or Firm* — Rabin & Berdo, P.C.

(57) ABSTRACT

The present invention uses the mutually series connected resistive, or inductive, or capacitive impedance to divide the voltage of bi-directional power source, thereby using the divided power of the impedance component to drive the bi-directional conducting light emitting diode in parallel connection at the two ends of the impedance.

27 Claims, 11 Drawing Sheets

BI-DIRECTIONAL LIGHT EMITTING DIODE DRIVE CIRCUIT IN BI-DIRECTIONAL DIVIDED POWER IMPEDANCE

BACKGROUND OF THE INVENTION (a) Field of the Invention

The bi-directional light emitting diode drive circuit in bi-directional divided power impedance is disclosed by that an AC power or a periodically alternated polarity power is used as the power source to supply to the resistive impedance components, or inductive impedance components, or capacitive impedance components in mutual series connection, whereby the power source voltage is divided. Thereof, it is characterized in that the said divided power across the two ends of the first impedance and the second impedance is used to drive a bi-directional conducting light emitting diode, or to drive at least two bi-directional conducting light emitting diode sets which are respectively parallel connected across the two ends of the first impedance and the second impedance.

(b) Description of the Prior Art

The conventional light emitting diode drive circuit using AC or DC power source is usually series connected with current limit resistors as the impedance to limit the current to the light emitting diode, whereof the voltage drop of the series connected resistive impedance always result in waste of power and accumulation of heat which are the imperfections.

SUMMARY OF THE INVENTION

The invention is that the first impedance is constituted by capacitive impedance components, inductive impedance components, or resistive impedance components and a second impedance is constituted by capacitive impedance components, inductive impedance components, or resistive impedance components; whereof, the first impedance and the second impedance are in series connection to receive the following:

(1) The AC power with a constant or variable voltage and a constant or variable frequency; or (2) The AC power of bi-directional sinusoidal wave voltage or bi-directional square wave voltage, or bi-directional pulse wave voltage with constant or variable voltage and constant or variable frequency or period which is converted from a DC power source; or (3) The AC power of bi-directional sinusoidal wave voltage or bi-directional square wave voltage, or bi-directional pulse wave voltage with constant or variable voltage and constant or variable frequency or period converted from the DC power which is further rectified from an AC power;

The divided power is formed at the first impedance and the second impedance through the input of above said powers, whereby the first light emitting diode and the second light emitting diode are parallel connected in reverse polarities to constitute a bi-directional conducting light emitting diode set which is parallel connected across the two ends of the second impedance and is driven by the divided power across the two ends of the second impedance to emit light.

DESCRIPTION OF MAIN COMPONENT SYMBOLS

C100, C102, C200: Capacitor
CR100, CR101, CR102, CR201, CR202: Diode
ESD101, ESD102: Charge/discharge device
I100, I103, I104, I200: Inductive impedance component
IT200: Separating type transformer
L100: Bi-directional conducting light emitting diode set
LED101: First light emitting diode
LED102: Second light emitting diode
R101, R102: Discharge resistor
R100, R103, R104: Current limit resistor
ST200: Self-coupled transformer
U100: Bi-directional light emitting diode (LED) drive circuit
W0: Self-coupled voltage change winding
W1: Primary side winding
W2: Secondary side winding
Z101: First impedance
Z102: Second impedance
ZD101, ZD102: Zener diode
300: Bi-directional power modulator of series connection type
400: Bi-directional power modulator of parallel connection type
500: Impedance component
600: Switching device
4000: DC to AC Inverter

DETAILED DESCRIPTION OF THE PREFERRED EMBODIMENTS

The bi-directional light emitting diode drive circuit in bi-directional divided power impedance is disclosed by that at least one first impedance is constituted capacitive impedance components, inductive impedance components, or resistive impedance components and at least one second impedance is constituted by capacitive impedance components, inductive impedance components, or resistive impedance components; at least one first light emitting diode and at least one second light emitting diode are in parallel connection of reverse polarities thereby to constitute at least one bi-directional conducting light emitting diode set which is parallel connected across the two ends of at least one second impedance, whereof the two ends of at least one first impedance and at least one second impedance in mutual series connection is provided to receive the following:

(1) The AC power with a constant or variable voltage and a constant or variable frequency; or (2) The AC power of bi-directional sinusoidal wave voltage or bi-directional square wave voltage, or bi-directional pulse wave voltage with constant or variable voltage and constant or variable frequency or period which is converted from a DC power source; or (3) The AC power of bi-directional sinusoidal wave voltage or bi-directional square wave voltage, or bi-directional pulse wave voltage with constant or variable voltage and constant or variable frequency or period converted from the DC power which is further rectified from an AC power;

The divided power is formed at the first impedance and the second impedance in series connection through the above said powers to drive at least one bi-directional conducting light emitting diode set, or to drive at least two bi-directional conducting light emitting diode sets which are respectively parallel connected across the two ends of the first impedance and the two ends of the second impedance, thereby to constitute the bi-directional light emitting diode drive circuit in bi-directional divided power impedance.

Figure 1:
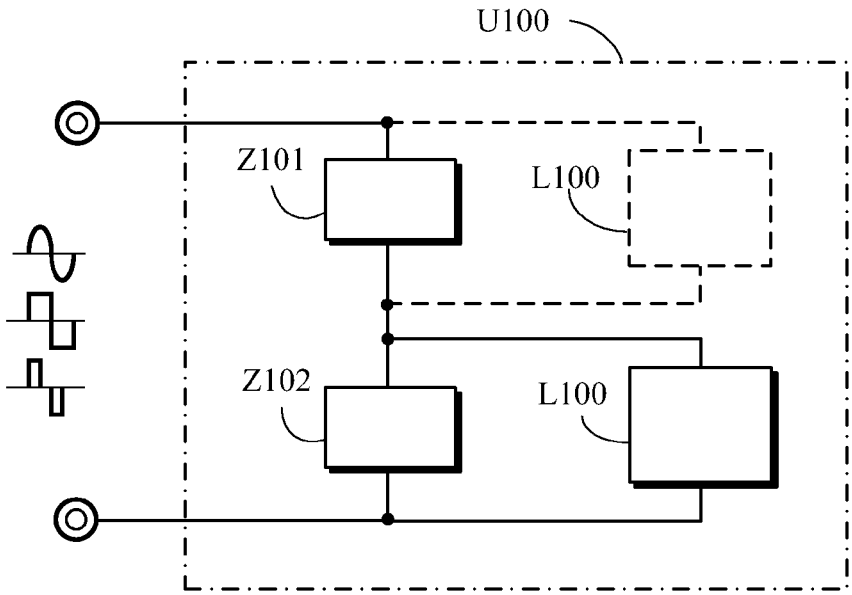
FIG. 1 is the schematic block diagram of the bi-directional light emitting diode drive circuit in bi-directional divided power impedance.

FIG. 1 is the schematic block diagram of the bi-directional light emitting diode drive circuit in bi-directional divided power impedance, in which the circuit function is operated through the bi-directional light emitting diode drive circuit (U100) as shown in FIG. 1, whereof it is comprised of that:

The first impedance (Z101) is comprised of that:

(1) It is constituted by one or more than one kinds and one or more than one of the capacitive impedance components or inductive impedance components or resistive impedance components, or can be optionally installed as needed by two or more than two kinds of impedance components, whereof each kind of impedance components has one or more than one components in series connection or parallel connection, or series and parallel connection; or (2) At least one capacitive impedance component and at least one inductive impedance component are in mutual series connection, whereof their frequency is the same as the frequency of the bi-directional power from power source such as the AC power, or the alternated polarity period of a constant or variable voltage and constant or variable periodically alternated polarity power converted from DC power, thereby to appear a series resonance impedance status; or (3) At least one capacitive impedance component and at least one inductive impedance component are in mutual parallel connection, whereof their frequency is the same as the frequency of the bi-directional power from power source such as the AC power, or the alternated polarity period of a constant or variable voltage and constant or variable periodically alternated polarity power converted from DC power, thereby to appear a parallel resonance impedance status; or The second impedance (Z102) is comprised of that:

(1) It is constituted by one or more than one kinds and one or more than one of the capacitive impedance components or inductive impedance components or resistive impedance components, or can be optionally installed as needed by two or more than two kinds of impedance components, whereof each kind of impedance components has one or more than one components in series connection or parallel connection, or series and parallel connection; or (2) At least one capacitive impedance component and at least one inductive impedance component are in mutual series connection, whereof their frequency is the same as the frequency of the bi-directional power from power source such as the AC power, or the alternated polarity period of a constant or variable voltage and constant or variable periodically alternated polarity power converted from DC power, thereby to appear a series resonance impedance status; or (3) At least one capacitive impedance component and at least one inductive impedance component are in mutual parallel connection, whereof their frequency is the same as the frequency of the bi-directional power from power source such as the AC power, or the alternated polarity period of a constant or variable voltage and constant or variable periodically alternated polarity power converted from DC power, thereby to appear a parallel resonance impedance status;

At least one first impedance (Z101) and at least one second impedance (Z102) are mutually series connected, whereof the two ends of the first impedance (Z101) and the second impedance (Z102) in series connection are provided for:

(1) The AC power with a constant or variable voltage and a constant or variable frequency; or (2) The AC power of bi-directional sinusoidal wave voltage or bi-directional square wave voltage, or bi-directional pulse wave voltage with constant or variable voltage and constant or variable frequency or period which is converted from a DC power source; or (3) The AC power of bi-directional sinusoidal wave voltage or bi-directional square wave voltage, or bi-directional pulse wave voltage with constant or variable voltage and constant or variable frequency or period converted from the DC power which is further rectified from an AC power;

A bi-directional conducting light emitting diode set (L100): It is constituted by at least one first light emitting diode (LED101) and at least one second light emitting diode (LED102) in parallel connection of reverse polarities, whereof the number of first light emitting diodes (LED101) and the number of second light emitting diodes (LED102) can be the same or different, and the first light emitting diode (LED101) and the second light emitting diode (LED102) are individually constituted by a forward current polarity light emitting diode, or by two or more than two forward current polarity light emitting diodes in series connection or parallel connection, or by three or more than three forward current polarity light emitting diodes in series connection, parallel connection or series and parallel connection. One or more than one set of the bi-directional conducting light emitting diode set (L100) can be optionally selected as needed to be parallel connected across the two ends of both or either of the first impedance (Z101) or the second impedance (Z102), whereof the divided power is formed across the two ends of first impedance (Z101) and the two ends of second impedance (Z102) through power input, whereby the bi-directional conducting light emitting diode set (L100) which is parallel connected across the two ends of the first impedance (Z101) or the two ends of the second impedance (Z102) is driven by the said divided power to emit light.

In the bi-directional light emitting diode drive circuit (U100), the first impedance (Z101) and the second impedance (Z102) as well as the bi-directional conducting light emitting diode set (L100) can be selected to be one or more than one as needed.

The divided power is formed at the first impedance and the second impedance in series connection through the above said powers to drive at least one bi-directional conducting light emitting diode set, or to drive at least two bi-directional conducting light emitting diode sets which are respectively parallel connected across the two ends of the first impedance and the two ends of the second impedance, thereby to constitute the bi-directional light emitting diode drive circuit in bi-directional divided power impedance.

Figure 2:
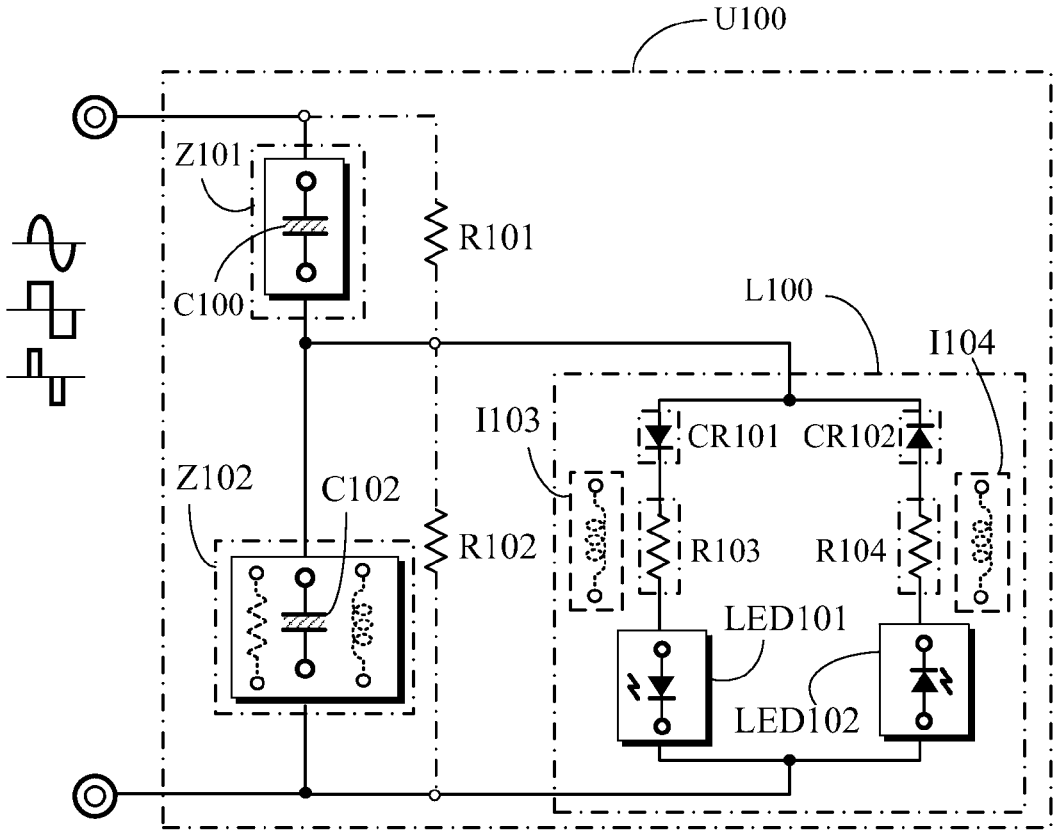
FIG. 2 is the circuit example schematic diagram of the invention.

For convenience of description, the components listed in the circuit examples of the following exemplary embodiments are selected as in the following:

(1) A first impedance (Z101) and a second impedance (Z102) as well as a bi-directional conducting light emitting diode set (L100) are installed in the embodied examples. Nonetheless, the selected quantities are not limited in actual applications;

(2) The capacitive impedance of the capacitor is selected to represent the impedance components, thereby to constitute the first impedance (Z101) and second impedance (Z102) in the embodied examples, whereof the capacitive, inductive and/or resistive impedance components can be optionally selected as needed in actual applications, whereby it is described in the following:

FIG. 2 is the circuit example schematic diagram of the invention which is mainly constituted by the following:

A first impedance (Z101): it is constituted by at least one capacitive impedance component, especially by the capacitor (C100), whereof the number of the first impedance can be one or more than one;

A second impedance (Z102): it is constituted by at least one capacitive impedance component, especially by the capacitor (C102), whereof the number of the second impedance can be one or more than one;

At least one first impedance (Z101) and the at least one second impedance are in series connection, whereof the two ends of them after series connection are provided for:

(1) The AC power with a constant or variable voltage and a constant or variable frequency; or (2) The AC power of bi-directional sinusoidal wave voltage or bi-directional square wave voltage, or bi-directional pulse wave voltage with constant or variable voltage and constant or variable frequency or period which is converted from a DC power source; or (3) The AC power of bi-directional sinusoidal wave voltage or bi-directional square wave voltage, or bi-directional pulse wave voltage with constant or variable voltage and constant or variable frequency or period converted from the DC power which is further rectified from an AC power;

Through above said power input, the divided power is formed at the first impedance and second impedance in series connection, whereby at least one bi-directional conducting light emitting diode set (L100) is driven by the said divided power.

A bi-directional conducting light emitting diode set (L100): it is constituted by at least one first light emitting diode (LED101) and at least one second light emitting diode (LED102) in parallel connection of reverse polarities, whereof the number of the first light emitting diode (LED101) and the number of the second light emitting diode (LED102) can be the same or different, further, the first light emitting diode (LED101) and the second light emitting diode (LED102) can be individually constituted by a forward current polarity light emitting diode; or two or more than two forward current polarity light emitting diodes in series or parallel connections; or three or more than three forward current polarity light emitting diodes in series or parallel connections or in series and parallel connections. The bi-directional conducting light emitting diode set (L100) can be optionally installed with one or more than one sets as needed, whereof it is parallel connected across the two ends of both of or either the first impedance (Z101) or the second impedance (Z102) to form the divided power which is used to drive the bi-directional conducting light emitting diode set (L100) which is parallel connected to the two ends of the first impedance (Z101) or the second impedance (Z102) to emit light; or At least one bi-directional conducting light emitting diode set (L100) is parallel connected to the two ends of at least one second impedance (Z102), i.e. it is parallel connected across the two ends of the capacitor (C102) which constitute the second impedance (Z102), thereby it is driven by the divided power across the two ends of the capacitor (C102) while the impedance of the first impedance (Z101) is used to limit its current, whereof in case that the capacitor (C100) (such as a bipolar capacitor) is used as the first impedance component, the output current is limited by the capacitive impedance;

The first impedance (Z101), the second impedance (Z102) and the bi-directional conducting light emitting diode set (L100) are connected according to the aforesaid circuit structure to constitute the bi-directional light emitting diode drive circuit (U100) and through the current distribution effect formed by the parallel connection of the bi-directional conducting light emitting diode set (L100) and the second impedance (Z102), the voltage variation rate across the two ends of the bi-directional conducting light emitting diode set (L100) corresponding to power source voltage variation can be reduced;

The bi-directional light emitting diode drive circuit in bi-directional divided power impedance, whereof selections of the first light emitting diode (LED101) and the second light emitting diode (LED102) which constitute the bi-directional conducting light emitting diode set (L100) in the bi-directional light emitting diode drive circuit (U100) include the following:

1. A first light emitting diode (LED101) which can be constituted by one light emitting diode, or by more than one light emitting diodes in series connection of forward polarities, or in parallel connection of the same polarity or in series and parallel connection;

2. A second light emitting diode (LED102) which can be constituted by one light emitting diode, or more than one light emitting diodes in series connection of forward polarities, or in parallel connection of the same polarity or in series and parallel connection;

3. The number of light emitting diodes which constitute the first light emitting diode (LED101) and the number of light emitting diodes which constitute the second light emitting diode can be the same or different;

4. If the number of light emitting diodes which constitute either the first light emitting diode (LED101) or the second light emitting diode (LED102) respectively is one or more than one, the connecting relationship of the respective light emitting diodes can be in the same or different series connection, parallel connection or series and parallel connection;

5. Either the first light emitting diode (LED101) or the second light emitting diode (LED102) can be replaced by a diode (CR100), whereof the current direction of the said (CR100) and the working current direction of either the first light emitting diode (LED101) or the second light emitting diode (LED102) which is reserved for parallel connection are in parallel connection of reverse polarities.

Figure 3:
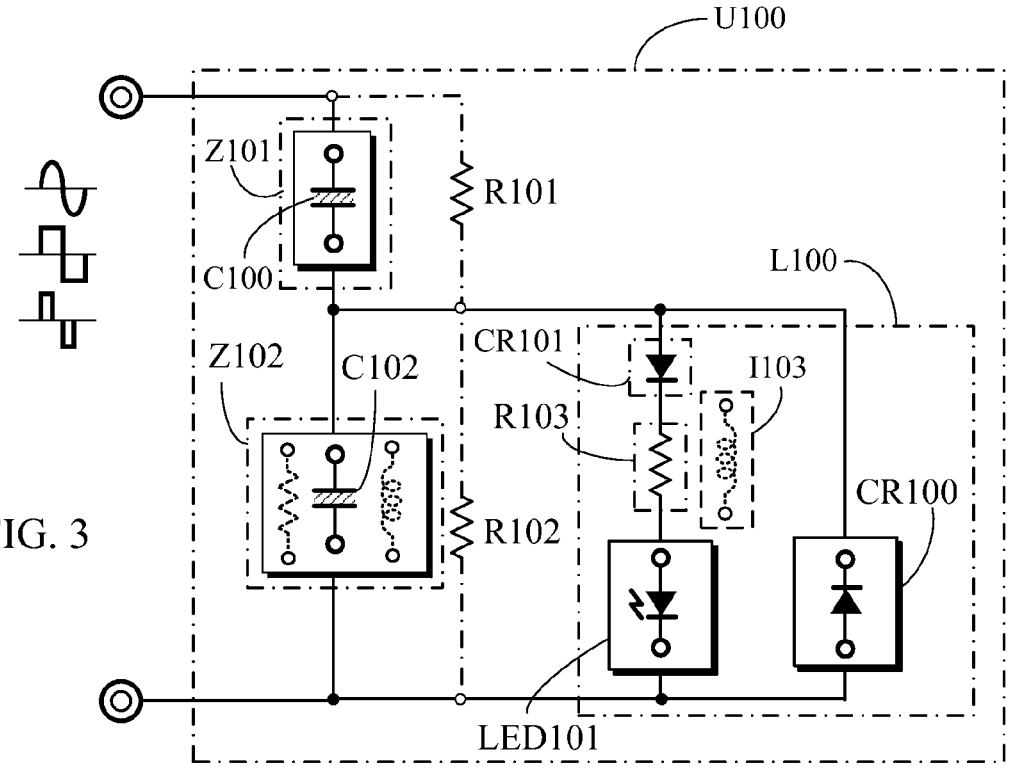
FIG. 3 is a circuit example schematic diagram of the invention illustrating that the bi-directional conducting light emitting diode set is constituted by a first light emitting diode and a diode in parallel connection of opposite polarities.

As shown in FIG. 3 which is a circuit example schematic diagram of the invention illustrating that the bi-directional conducting light emitting diode set is constituted by a first light emitting diode and a diode in parallel connection of reverse polarities.

Figure 4:
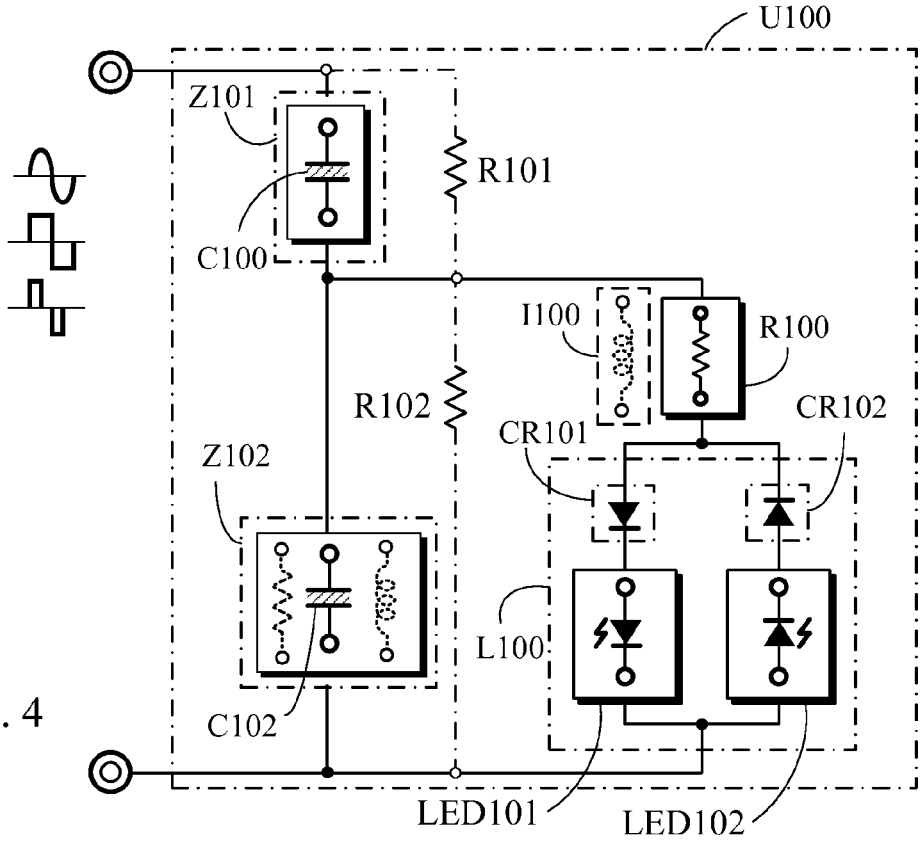
FIG. 4 is a circuit example schematic diagram illustrating that the bi-directional conducting light emitting diode set is series connected with a current limit resistor.
Figure 5:
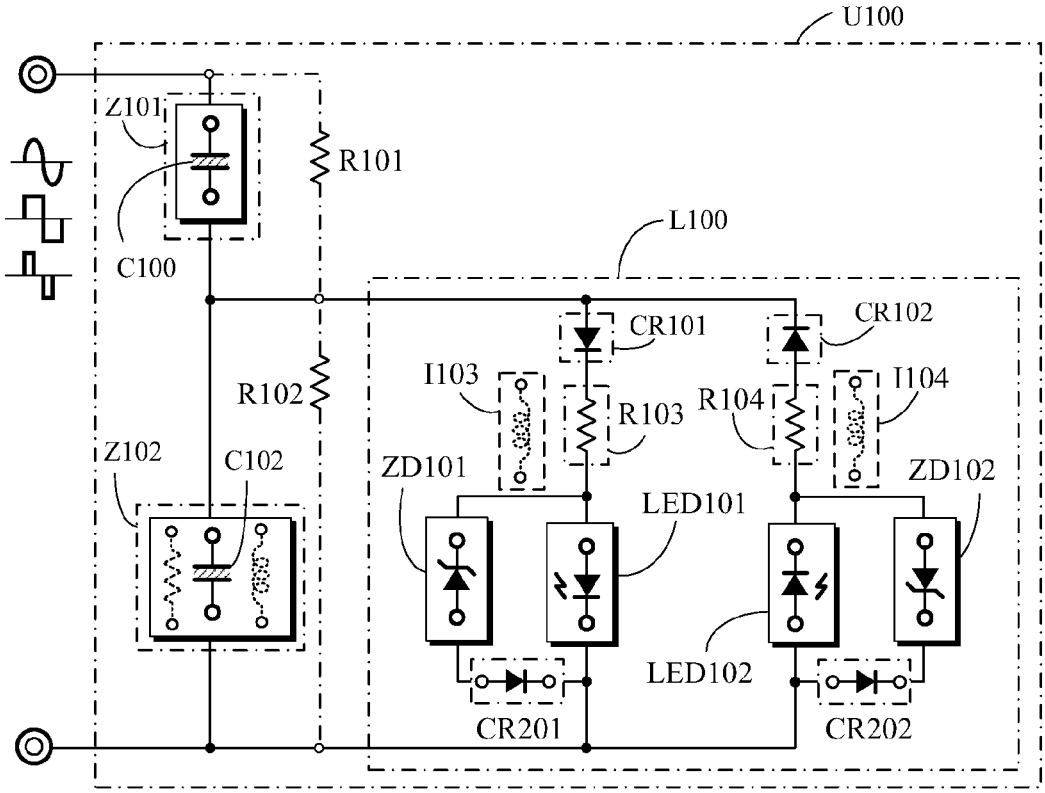
FIG. 5 is a circuit example schematic diagram illustrating that the bi-directional conducting light emitting diode set in the circuit of FIG. 2 is further installed with a zener diode.
Figure 6:
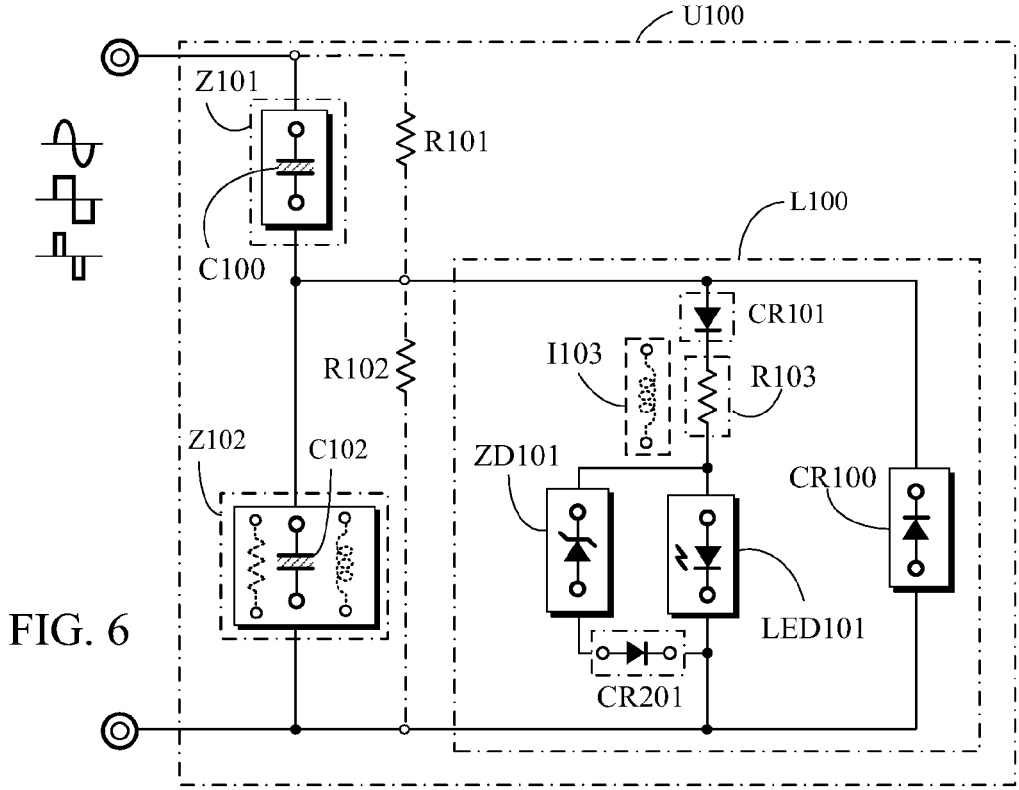
FIG. 6 is a circuit example schematic diagram illustrating that the bi-directional conducting light emitting diode set in the circuit of FIG. 3 is further installed with a zener diode.

The bi-directional light emitting diode drive circuit can be as shown in FIGS. 1, 2 and 3 when it is in actual applications the following auxiliary circuit components can be optionally selected as needed to be installed or not installed while the quantity of the installation can be constituted by one or more than one, whereof in case more than one are selected, they can be selected based on circuit function requirements to be in series connection or parallel connection or series and parallel connection in corresponding polarities, whereof the optionally selected auxiliary circuit components include:

A diode (CR101): It is optionally installed as needed to series connect with the first light emitting diode (LED101) to avoid reverse over-voltage;

A diode (CR102): It is optionally installed as needed to series connect with the second light emitting diode (LED102) to avoid reverse over-voltage;

A discharge resistor (R101): It is an optionally installed component as needed to parallel connect across the two ends of the capacitor (C100) of the first impedance (Z101) for releasing the residual charge of capacitor (C100);

A discharge resistor (R102): It is an optionally installed component as needed to parallel connect across the two ends of the capacitor (C102) of second impedance (Z102) for releasing the residual charge of capacitor (C102);

A current limit resistor (R103): It is an optionally installed component as needed to individually series connect with each of the first light emitting diodes (LED101) of the bi-directional conducting light emitting diode set (L100), whereby it is used to limit the current passing through the first light emitting diode (LED101); whereof the current limit resistor (R103) can also be replaced by an inductive impedance component (I103);

A current limit resistor (R104): It is an optionally installed component as needed to individually series connect with each of the second light emitting diodes (LED102) of the bi-directional conducting light emitting diode set (L100), whereby it is used to limit the current passing through the second light emitting diode (LED102); whereof the current limit resistor (R104) can also be replaced by an inductive impedance component (I104);

The current limit resistors (R103) and (R104) can be respectively installed to the first light emitting diode (LED101) and the second light emitting diode (LED102) of the bi-directional conducting light emitting diode set (L100) simultaneously in the bi-directional light emitting diode drive circuit (U100), or they can be replaced by or installed together with a current limit resistor (R100) to directly series connect with the bi-directional conducting light emitting diode set (L100) to obtain the current limit function, whereof the current limit resistor (R100) can also be replaced by an inductive impedance component (I100). The bi-directional light emitting diode drive circuit (U100) is thus constituted by the said circuit structure and selection of auxiliary circuit components as shown in FIG. 4 which is a circuit example schematic diagram illustrating that the bi-directional conducting light emitting diode set is series connected with a current limit resistor;

In addition, for protecting the light emitting diode and to avoid the light emitting diode being damaged or reduced working life by abnormal voltage, a zener diode can be further parallel connected across the two ends of the first light emitting diode (LED101) and the second light emitting diode (LED102) in the bi-directional conducting light emitting diode set (L100) of the bi-directional light emitting diode drive circuit (U100) as shown in circuit examples of FIGS. 5, 6, or the zener diode is first series connected with at least one diode to produce a zener voltage function, then parallel connected across the two ends of the first light emitting diode (LED101) or of the second light emitting diode (LED102);

As shown in FIG. 5 which is a circuit example schematic diagram illustrating that the bi-directional conducting light emitting diode set in the circuit of FIG. 2 is further installed with a zener diode.

Figure 7:
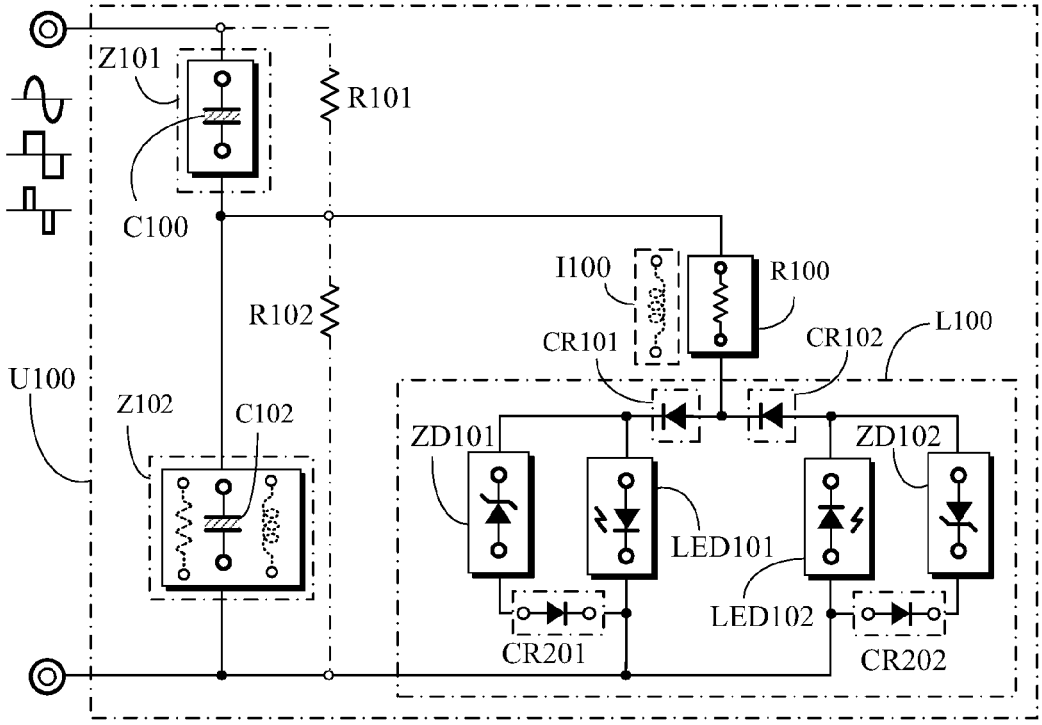
FIG. 7 is a circuit example schematic diagram illustrating that the bi-directional conducting light emitting diode set in the circuit of FIG. 4 is further installed with a zener diode.

FIG. 6 is a circuit example schematic diagram illustrating that the bi-directional conducting light emitting diode set in the circuit of FIG. 3 is further installed with a zener diode;

FIG. 7 is a circuit example schematic diagram illustrating that the bi-directional conducting light emitting diode set in the circuit of FIG. 4 is further installed with a zener diode; whereof it is constituted by the following:

1. A zener diode (ZD101) is parallel connected across the two ends of the first light emitting diode (LED101) of the bi-directional conducting light emitting diode set (L100), whereof its polarity relationship is that the zener voltage of the zener diode (ZD101) is used to limit the working voltage across the two ends of the first light emitting diode (LED101);

The said zener diode (ZD101) can be optionally series connected with a diode (CR201) as needed, whereof the advantages are 1) the zener diode (ZD101) can be protected from reverse current; 2) both diode (CR201) and zener diode (ZD101) have temperature compensation effects.

2. If the second light emitting diode (LED102) is selected to constitute the bi-directional conducting light emitting diode set (L100), a zener diode (ZD102) can be selected to parallel connect across the two ends of the second light emitting diode (LED102), whereof their polarity relationship is that the zener voltage of the zener diode (ZD102) is used to limit the working voltage across the two ends of the second light emitting diode (LED102);

The said zener diode (ZD102) can be optionally series connected with a diode (CR202) as needed, whereof the advantages are 1) the zener diode (ZD102) can be protected from reverse current; 2) both diode (CR202) and zener diode (ZD102) have temperature compensation effects.

Figure 8:
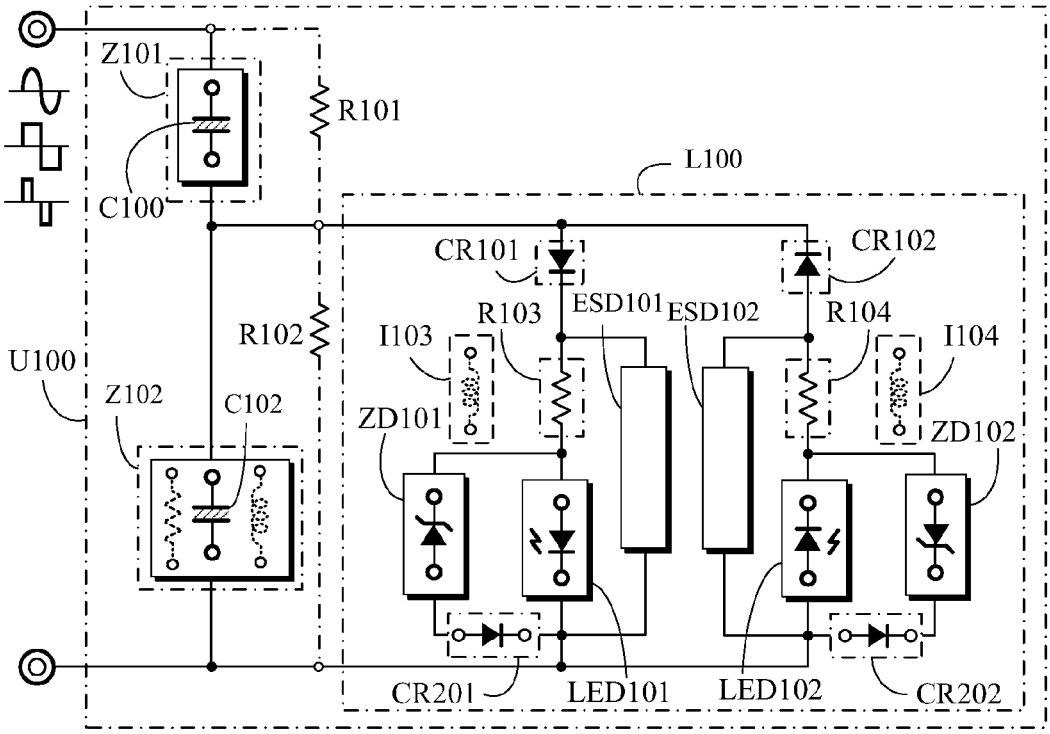
FIG. 8 is a circuit example schematic diagram illustrating that the charge/discharge device is parallel connected across the two ends of a light emitting diode and a current limit resistor in series connection in the circuit of FIG. 5.
Figure 9:
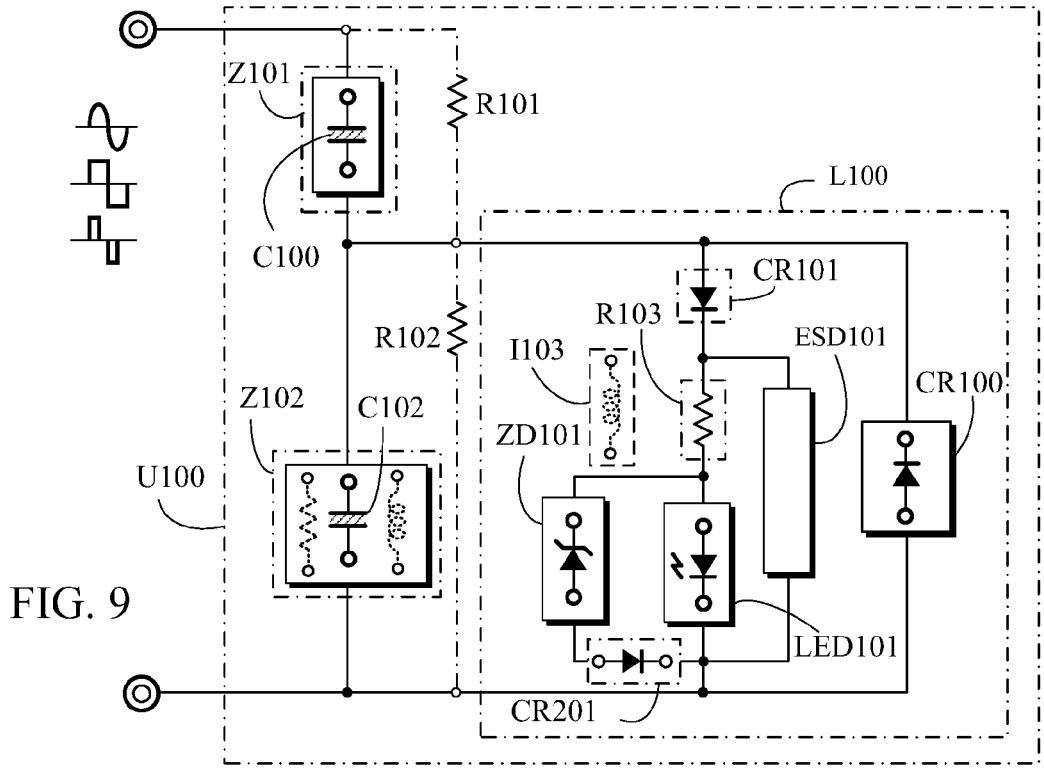
FIG. 9 is a circuit example schematic diagram illustrating that the charge/discharge device is parallel connected across the two ends of a light emitting diode and a current limit resistor in series connection in the circuit of FIG. 6.
Figure 10:
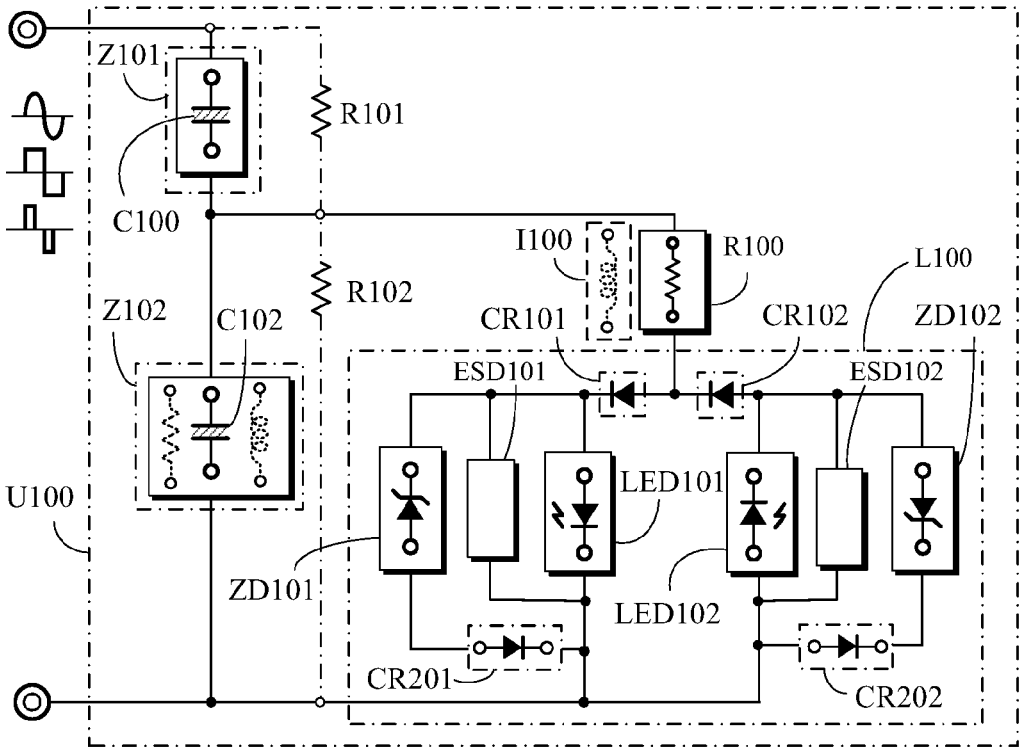
FIG. 10 is a circuit example schematic diagram illustrating that the charge/discharge device is parallel connected across the two ends of a light emitting diode and a current limit resistor in series connection in the circuit of FIG. 7.

The zener diode is constituted by the following:

(1) A zener diode (ZD101) is parallel connected across the two ends of the first light emitting diode (LED101) of the bi-directional conducting light emitting diode set (L100), and a zener diode (ZD102) is parallel connected across the two ends of the second light emitting diode (LED102); or (2) The two zener diodes (ZD101) and (ZD102) are reversely series connected and are further parallel connected across the two ends of the bi-directional conducting light emitting diode set (L100); or (3) It can be replaced by parallel connecting a diode with bi-directional zener effect in the circuit of bi-directional conducting light emitting diode set (L100); all the above said three circuits can avoid over high end voltage of the first light emitting diode (LED101) and the second light emitting diode (LED102);

The bi-directional light emitting diode drive circuit (U100) of the bi-directional driving light emitting diode drive circuit in bi-directional divided power impedance as shown in the circuit examples of FIGS. 8, 9 and 10, whereof to promote the lighting stability of the light source produced by the light emitting diode, the first light emitting diode (LED101) can be installed with a charge/discharge device (ESD101), or the second light emitting diode (LED102) can be installed with a charge/discharge device (ESD102), whereof the charge/discharge device (ESD101) and the charge/discharge device (ESD102) have the random charging or discharging characteristics which can stabilize the lighting stability of the first light emitting diode (LED101) and the second light emitting diode (LED102), whereby to reduce their lighting pulsations. The aforesaid charge/discharge devices (ESD101), (ESD102) can be constituted by the conventional charging and discharging batteries, or super-capacitors or capacitors, etc;

The bi-directional light emitting diode drive circuit in bi-directional divided power impedance can be further optionally installed with a charge/discharge device as needed, whereof it includes:

1. The bi-directional light emitting diode drive circuit in bi-directional divided power impedance, whereof in its bi-directional light emitting diode drive circuit (U100), a charge/discharge device (ESD101) can be parallel connected across the two ends of the current limit resistor (R103) and the first light emitting diode (LED101) in series connection;

Or a charge/discharge device (ESD102) can be further parallel connected across the two ends of the current limit resistor (R104) and the second light emitting diode (LED 102) in series connection FIG. 8 is a circuit example schematic diagram illustrating that a charge/discharge device is parallel connected across the two ends of the first light emitting diode, the second light emitting diode and current limit resistor in series connection in the circuit of FIG. 5, whereof it is comprised of:

A charge/discharge device (ESD101) based on its polarity is parallel connected across the two ends of the first light emitting diode (LED101) and the current limit resistor (R103) in series connection, or is directly parallel connected across the two ends of the first light emitting diode (LED101), whereof the charge/discharge device (ESD101) has the random charge/discharge characteristics to stabilize the lighting operation and to reduce the lighting pulsation of the first light emitting diode (LED101);

If the second light emitting diode (LED 102) is selected to use, a charge/discharge device (ESD102) based on its polarity is parallel connected across the two ends of the second light emitting diode (LED 102) and the current limit resistor (R104) in series connection, whereof the charge/discharge device (ESD102) has the random charge/discharge characteristics to stabilize the lighting operation and to reduce the lighting pulsation of the second light emitting diode (LED 102);

The aforesaid charge/discharge devices (ESD101), (ESD102) can be constituted by the conventional charging and discharging batteries, or super-capacitors or capacitors, etc.

2. The bi-directional light emitting diode drive circuit in bi-directional divided power impedance, whereof if a first light emitting diode (LED101) is selected and is reversely parallel connected with a diode (CR100) in the bi-directional light emitting diode drive circuit (U100), then its main circuit structure is as shown in FIG. 9 which is a circuit example schematic diagram illustrating that a charge/discharge device is parallel connected across the two ends of the light emitting diode and the current limit resistor in series connection in the circuit of FIG. 6, whereof a charge/discharge device (ESD101) based on its polarity is parallel connected across the two ends of the first light emitting diode (LED101) and the current limit resistor (R103) in series connection, whereof the charge/discharge device (ESD101) has the random charge/discharge characteristics to stabilize the lighting operation and to reduce the lighting pulsation of the first light emitting diode (LED101);

The aforesaid charge/discharge devices (ESD101), (ESD102) can be constituted by the conventional charging and discharging batteries, or super-capacitors or capacitors, etc.

3. In the bi-directional light emitting diode drive circuit (U100) of the bi-directional light emitting diode drive circuit in bi-directional divided power impedance of the invention, when the current limit resistor (R100) is selected to replace the current limit resistors (R103), (R104) to serve as the common current limit resistor of the bi-directional conducting light emitting diode set (L100) in the light emitting diode drive circuit (U100), or the current limit resistors (R103), (R104) and (R100) are not installed, the main circuit structure is as shown in FIG. 10 which is a circuit example schematic diagram illustrating that a charge/discharge device is parallel connected across the two ends of the light emitting diode and the current limit resistor in series connection in the circuit of FIG. 7, whereof it is comprised of that:

A charge/discharge device (ESD101) is directly parallel connected across the two ends of the first light emitting diode (LED101) of the same polarity, and a charge/discharge device (ESD102) is directly parallel connected across the two ends of the second light emitting diode (LED102) of the same polarity, whereof the charge/discharge devices (ESD101) and (ESD102) has the random charge or discharge characteristics;

The aforesaid charge/discharge devices (ESD101), (ESD102) can be constituted by the conventional charging and discharging batteries, or super-capacitors or capacitors, etc.

4. If the charge/discharge devices (ESD101) or (ESD102) used is uni-polar in the above said items 1, 2, 3, after the first light emitting diode (LED101) is parallel connected with the uni-polar charge/discharge device (ESD101), a diode (CR101) of forward polarity series connection can be optionally installed as needed to prevent reverse voltage from damaging the uni-polar charge/discharge device; whereof after the second light emitting diode (LED102) is parallel connected with the uni-polar charge/discharge device (ESD102), a diode (CR102) of forward polarity series connection can be optionally installed as needed to prevent reverse voltage from damaging the uni-polar charge/discharge device;

5. The two ends of the bi-directional conducting light emitting diode set (L100) can be optionally parallel connected with a bipolar charge/discharge device as needed.

In addition, a charge/discharge device (ESD101) or a charge/discharge device (ESD102) can be further installed across the two ends of the bi-directional conducting light emitting diode set (L100) in the bi-directional light emitting diode drive circuit (U100) for random charging/discharging, thereby besides of stabilizing the lighting stabilities of the first light emitting diode (LED101) and the second light emitting diode (LED102) of the bi-directional conducting light emitting diode set (L100), the charge/discharge device can provide its saving power during a power off to drive at least one of the first light emitting diode (LED101) or the second light emitting diode (LED102) to continue emitting light;

The aforesaid charge/discharge devices (ESD101), (ESD102) can be constituted by the conventional charging and discharging batteries, or super-capacitors or capacitors, etc.

Figure 11:
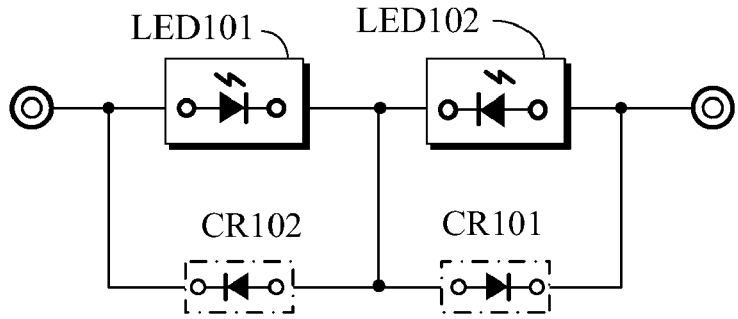
FIG. 11 is a circuit example schematic diagram of the bi-directional conducting light emitting diode set of the invention illustrating that the first light emitting diode is reversely parallel connected with a diode, and the second light emitting diode is reversely parallel connected with a diode, whereby the two appear in series connection of opposite directions.

The aforesaid bi-directional conducting light emitting diode set (L100), in which the lighting functions of the said bi-directional light emitting diodes are constituted by the following:

(1) It is constituted by at least one first light emitting diode (LED101) and at least one second light emitting diode (LED102) in parallel connection of opposite polarities;

(2) At least one first light emitting diode (LED101) is series connected in forward polarity with a diode (CR101), and at least one second light emitting diode (LED102) is series connected with a diode (CR102) in forward polarity, thereby the two are further reversely parallel connected;

(3) A diode (CR101) is parallel connected with at least one first light emitting diode (LED101) in opposite polarities, and a diode (CR102) is parallel connected with at least one second light emitting diode (LED102) in opposite polarities, whereof the two are further reversely series connected to constitute a bi-directional conducting light emitting diode set, whereof it is as shown in FIG. 11 which is a circuit example schematic diagram of the bi-directional conducting light emitting diode set of the invention illustrating that the first light emitting diode is reversely parallel connected with a diode, and the second light emitting diode is parallel connected with a diode in reverse polarities, whereby the two appear in reversely series connection.

(4) Or it can be constituted by conventional circuit combinations or components which allow the light emitting diode to receive power and to emit light bi-directionally.

The first impedance (Z101), the second impedance (Z102) and the bi-directional conducting light emitting diode set (L100) as well as the first light emitting diode (LED101), the second light emitting diode (LED102) and various aforesaid optional auxiliary circuit components as shown in the circuit examples of FIGS. 1~11 are based on application needs, whereof they can be optionally installed or not installed as needed and the installation quantity include constitution by one, wherein if more than one are selected, the corresponding polarity relationship shall be determined based on circuit function requirement to execute series connection, or parallel connection or series and parallel connections; thereof it is constituted as the following:

1. The first impedance (Z101) can be constituted by one capacitor (C100) or by more than one capacitors (C100) in series connection or parallel connection or series and parallel connection, whereof in multiple installations, each first impedance can be constituted by the same kind of capacitive impedance components, inductive impedance components, or resistive impedance components, or other different kinds of impedance components, in which their impedance values can be the same or different;

2. The second impedance (Z102) can be constituted by one or by more than one in series connection or parallel connection or series and parallel connection, whereof in multiple installations, each second impedance can be constituted by the same kind of capacitive impedance components, inductive impedance components, or resistive impedance components, or other different kinds of impedance components, in which their impedance values can be the same or different;

3. The first light emitting diode (LED101) can be constituted by one or by more than one in series connection of forward polarities, or in parallel connection of the same polarity, or in series and parallel connection;

4. The second light emitting diode (LED102) can be constituted by one or by more than one in series connection of forward polarities, or in parallel connection of the same polarity, or in series and parallel connection;

5. In the bi-directional light emitting diode drive circuit (U100):

(1) It can be optionally installed with one bi-directional conducting light emitting diode set (L100) or with more than one bi-directional conducting light emitting diode sets (L100) in series connection, parallel connection or series and parallel connection, whereof if one set or more than one sets are selected to be installed, they can be jointly driven by the divided power of the same second impedance (Z102) or driven individually by the corresponding divided power at each of the multiple second impedances (Z102) which are in series connection or parallel connection;

(2) If a charge/discharge device (ESD101) or (ESD102) is installed in the bi-directional light emitting diode drive circuit (U100), then the light emitting diode (LED101) or (LED102) of the bi-directional conducting light emitting diode set (L100) is driven by DC power to emit light continuously;

If the charge/discharge device (ESD101) or (ESD102) is not installed, then current conduction to light emitting diode (LED101) or (LED102) is intermittent, whereby referring to the input voltage wave shape and duty cycle of current conduction, the light emitting forward current and the peak of light emitting forward voltage of each light emitting diode in the bi-directional conducting light emitting diode set (L100) can be correspondingly selected for the light emitting diode (LED101) or (LED102), whereof the selections include the following:

1) The light emitting peak of forward voltage is lower than the rated forward voltage of light emitting diode (LED 101) or (LED102); or 2) The rated forward voltage of light emitting diode (LED101) or (LED102) is selected to be the light emitting peak of forward voltage; or 3) If current conduction to light emitting diode (LED101) or (LED102) is intermittent, the peak of light emitting forward voltage can be correspondingly selected based on the duty cycle of current conduction as long as the principle of that the peak of light emitting forward voltage does not damage the light emitting diode (LED101) or (LED102) is followed;

Based on the value and wave shape of the aforesaid light emitting forward voltage, the corresponding current value and wave shape from the forward voltage vs. forward current ratio are produced; however the peak of light emitting forward current shall follow the principle not to damage the light emitting diode (LED101) or (LED102);

The luminosity or the stepped or step-less luminosity modulation of the forward current vs. relative luminosity can be controlled based on the aforesaid value and wave shape of forward current;

6. The diode (CR100), (CR101), (CR102), (CR201) and (CR202) can be constituted by one diode, or by more than one diodes in series connection of forward polarity, or in parallel connection of the same polarity, or in series and parallel connection, whereof said devices can be optionally installed as needed;

7. The discharge resistor (R101), (R102) and current limit resistors (R100), (R103), (R104) can be constituted by one resistor, or by more than one resistors in series connection or parallel connection or series and parallel connection, whereof said devices can be optionally installed as needed;

8. The inductive impedance components (I100), (I103), (I104) can be constituted by one impedance component, or by more than one impedance components in series connection or parallel connection or series and parallel connection, whereof said devices can be optionally installed as needed;

9. The zener diodes (ZD101), (ZD102) can be constituted by one zener diode, or by more than one zener diodes in series connection of forward polarities, or in parallel connection of the same polarity, or in series and parallel connection, whereof said devices can be optionally installed as needed.

Figure 12:
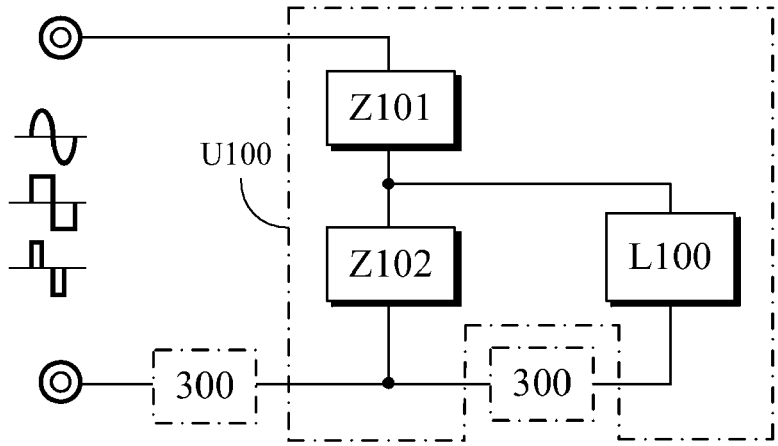
FIG. 12 is a circuit example schematic block diagram of the invention which is series connected to the bi-directional power input modulator of series connection type.

10. The charge/discharge devices (ESD101), (ESD102) can be constituted by one, or by more than one in series connection or parallel connection or series and parallel connection, whereof said devices can be optionally installed as needed;

In the application of the bi-directional light emitting diode drive circuit (U100), the following different types of bi-directional AC power can be provided for inputs, whereof the bi-directional power includes that:

(1) The AC power with a constant or variable voltage and a constant or variable frequency; or (2) The AC power of bi-directional sinusoidal wave voltage or bi-directional square wave voltage, or bi-directional pulse wave voltage with constant or variable voltage and constant or variable frequency or period which is converted from a DC power source; or (3) The AC power of bi-directional sinusoidal wave voltage or bi-directional square wave voltage, or bi-directional pulse wave voltage with constant or variable voltage and constant or variable frequency or period converted from the DC power which is further rectified from an AC power;

In addition, the following active modulating circuit devices can be further optionally combined as needed, whereof the applied circuits are the following:

1. FIG. 12 is a circuit example schematic block diagram of the invention which is series connected to the bi-directional power modulator of series connection type, whereof the bi-directional power modulator of series connection type is constituted by the following:

A bi-directional power modulator of series connection type (300): It is constituted by the conventional electromechanical components or solid state power components and related electronic circuit components to modulate the bi-directional power output.

Figure 13:
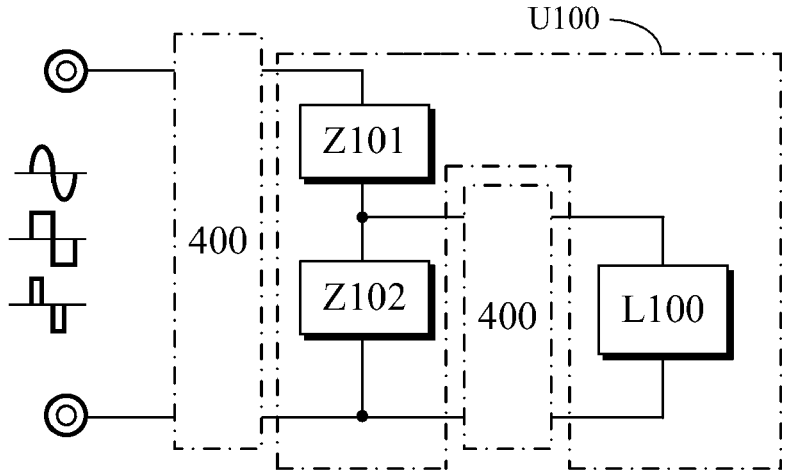
FIG. 13 is a circuit example schematic block diagram of the invention which is parallel connected to the bi-directional power input modulator of parallel connection type.

The circuit operating functions are the following:

(1) The bi-directional power modulator of series connection type (300) can be optionally installed as needed to be series connected with the bi-directional light emitting diode drive circuit (U100) to receive the bi-directional power from power source, whereby the bi-directional power is modulated by the bi-directional power modulator of series connection type (300) to execute power modulations such as pulse width modulation or current conduction phase angle control, or impedance modulation, etc. to drive the bi-directional light emitting diode drive circuit (U100); or (2) The bi-directional power modulator of series connection type (300) can be optionally installed as needed to be series connected between the second impedance (Z102) and the bi-directional conducting light emitting diode set (L100) whereby the bi-directional divided power across the two ends of the second impedance (Z102) is modulated by the bi-directional power modulator of series connection type (300) to execute power modulations such as pulse width modulation or current conduction phase angle control, or impedance modulation, etc. to drive the bi-directional conducting light emitting diode set (L100);

2. FIG. 13 is a circuit example schematic block diagram of the invention which is parallel connected to a bi-directional power modulator of parallel connection type, whereof the bi-directional power modulator of parallel connection type is constituted by the following:

A bi-directional power modulator of parallel connection type (400): It is constituted by the conventional electromechanical components or solid state power components and related electronic circuit components to modulate the bi-directional power output.

Figure 14:
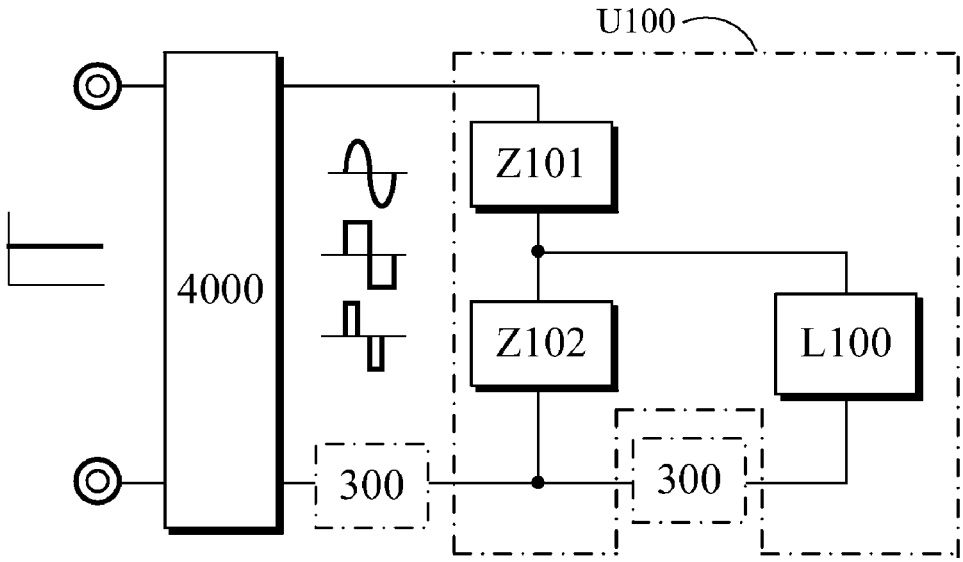
FIG. 14 is a circuit example schematic block diagram illustrating that the invention is series connected with a bi-directional power modulator of series connection type to receive the output power of the DC to AC inverter.
Figure 15:
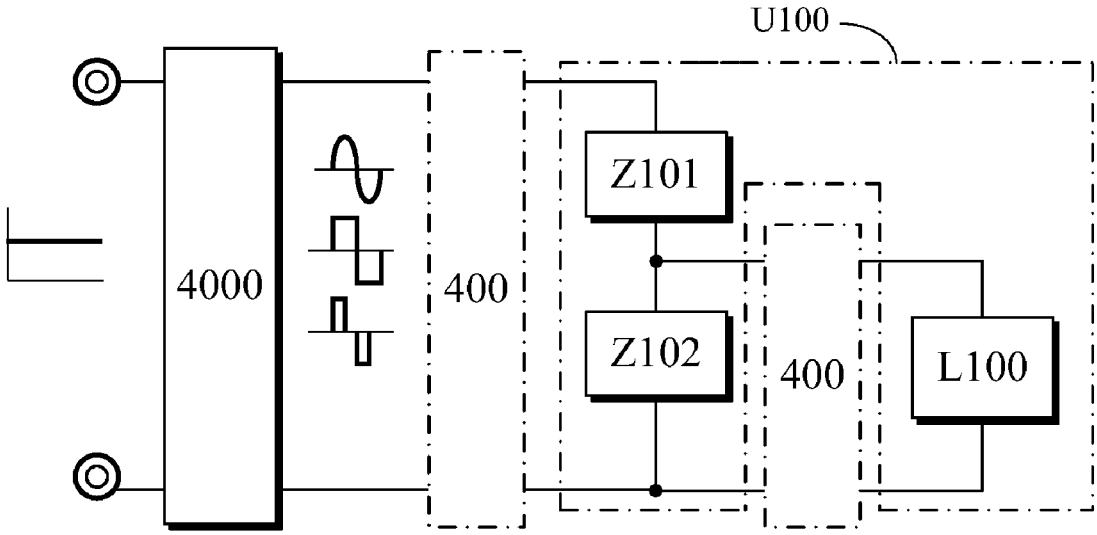
FIG. 15 is a circuit example schematic block diagram illustrating that the invention is parallel connected with a bi-directional power modulator of parallel connection type to receive the output power of the DC to AC inverter.
Figure 16:
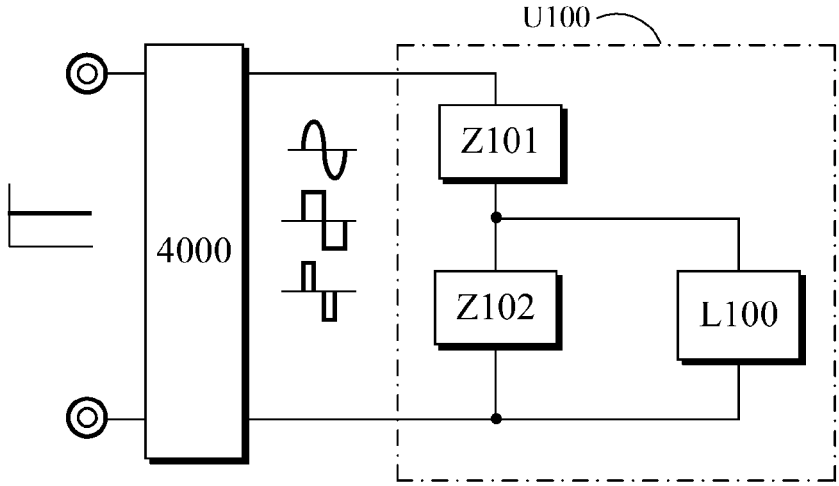
FIG. 16 is a circuit example schematic block diagram of the invention driven by the DC to AC inverter output power.

The circuit operating functions are the following:

(1) The bi-directional power modulator of parallel connection type (400) can be optionally installed as needed, whereof its output ends are for parallel connection with the bi-directional light emitting diode drive circuit (U100), while its input ends are provided for receiving the bi-directional power from the power source, whereby the bi-directional power is modulated by the bi-directional power modulator of parallel connection type (400) to execute power modulations such as pulse width modulation or current conduction phase angle control, or impedance modulation, etc. to drive the bi-directional light emitting diode drive circuit (U100); or (2) The bi-directional power modulator of parallel connection type (400) can be optionally installed as needed, whereof its output ends are parallel connected with the input ends of the bi-directional conducting light emitting diode set (L100) while its input ends are parallel connected with the second impedance (Z102), whereby the bi-directional divided power across the two ends of the second impedance (Z102) is modulated by the bi-directional power modulator of parallel connection type (400) to execute power modulations such as pulse width modulation or current conduction phase angle control, or impedance modulation, etc. to drive the bi-directional conducting light emitting diode set (L100);

3. FIG. 14 is a circuit example schematic block diagram illustrating that the invention is series connected with a bi-directional power modulator of series connection type to receive the output power of the DC to AC inverter, whereof the constitution of the DC to AC inverter and the bi-directional power modulator of series connection type include the following:

A DC to AC Inverter (4000): it is constituted by the conventional electromechanical components or solid state power components and related electronic circuit components, whereof its input ends are optionally provided as needed to receive input from a constant or variable voltage DC power, or a DC power rectified from an AC power, while its output ends are optionally selected as needed to supply a bi-directional power of bi-directional sinusoidal wave, or bi-directional square wave or bi-directional pulse wave in a constant or variable voltage and constant or variable alternated polarity frequency or period to be used as the power source to supply bi-directional power;

A bi-directional power modulator of series connection type (300): It is constituted by the conventional electromechanical components or solid state power components and related electronic circuit components to modulate the bi-directional power output;

The circuit operating functions are described in the following:

(1) The bi-directional power modulator of series connection type (300) can be optionally installed as needed to series connect with the bi-directional light emitting diode drive circuit (U100). After the two are in series connection, they are parallel connected with the output ends of the DC to AC inverter (4000), and the bi-directional power output of the DC to AC inverter (4000) is modulated by the bi-directional power modulator of series connection type (300) to execute power modulations such as pulse width modulation or current conduction phase angle control, or impedance modulation, etc. to drive the bi-directional light emitting diode drive circuit (U100); or (2) The bi-directional power modulator of series connection type (300) can be optionally installed as needed to be series connected between the second impedance (Z102) and the bi-directional conducting light emitting diode set (L100), whereby the bi-directional divided power across the two ends of the second impedance (Z102) is used to execute power modulations such as pulse width modulation or current conduction phase angle control, or impedance modulation, etc. to drive the bi-directional conducting light emitting diode set (L100);

4. FIG. 15 is a circuit example schematic block diagram illustrating that the invention is parallel connected with a bi-directional power modulator of parallel connection type to receive the output power of the DC to AC inverter; whereof the constitution of the DC to AC inverter and bi-directional power modulation of parallel connection type include the following:

A DC to AC Inverter (4000): it is constituted by the conventional electromechanical components or solid state power components and related electronic circuit components, whereof its input ends are optionally provided as needed to receive input from a constant or variable voltage DC power, or a DC power rectified from an AC power, while its output ends are optionally selected as needed to supply bi-directional power of bi-directional sinusoidal wave, or bi-directional square wave or bi-directional pulse wave in a constant or variable voltage and constant or variable alternated polarity frequency or periods to be used as the power source to supply bi-directional power;

A bi-directional power modulator of parallel connection type (400): It is constituted by the conventional electromechanical components or solid state power components and related electronic circuit components to modulate the bi-directional power output;

The circuit operating functions are described in the following:

(1) A bi-directional power modulator of parallel connection type (400) can be optionally installed as needed, whereof its output ends are parallel connected with the input ends of the bi-directional light emitting diode drive circuit (U100) and its input ends are provided to receive the bi-directional power output from the DC to AC inverter (4000), whereby the bi-directional power output of the DC to AC invert (4000) is modulated by the bi-directional power modulator of parallel connection type (400) to execute power modulations such as pulse width modulation or current conduction phase angle control, or impedance modulation, etc. to drive the bi-directional light emitting diode drive circuit (U100); or (2) The bi-directional power modulator of parallel connection type (400) can be optionally installed as needed, whereof its output ends are parallel connected with the input ends of the bi-directional conducting light emitting diode set (L100) while its input ends are parallel connected with the second impedance (Z102), whereby the bi-directional divided power across the two ends of the second impedance (Z102) is modulated by the bi-directional power modulator of parallel connection type (400) to execute power modulations such as pulse width modulation or current conduction phase angle control, or impedance modulation, etc. to drive the bi-directional conducting light emitting diode set (L100);

5. FIG. 16 is a circuit example schematic block diagram of the invention driven by a DC to AC inverter output power;

It is mainly comprised of that:

A DC to AC Inverter (4000): it is constituted by the conventional electromechanical components or solid state power components and related electronic circuit components, whereof its input ends are optionally provided as needed to receive input from a constant or variable voltage DC power, or a DC power rectified from an AC power, while its output ends are optionally selected as needed to supply bi-directional power of bi-directional sinusoidal wave, or bi-directional square wave or bi-directional pulse wave in a constant or variable voltage and constant or variable alternated polarity frequency or periods to be used as the power source to supply bi-directional power;

The circuit operating functions are the following:

The bi-directional light emitting diode drive circuit (U100) is parallel connected across the output ends of the conventional DC to AC inverter (4000); the input ends of the DC to AC inverter (4000) are optionally provided as needed to receive input from a constant or variable voltage DC power, or a DC power rectified from an AC power;

The output ends of the DC to AC inverter (4000) can be optionally selected as needed to provide a bi-directional power of bi-directional sinusoidal wave, or bi-directional square wave or bi-directional pulse wave in a fixed or variable voltage and constant or variable polarity frequency or period as the bi-directional power source to control and drive the bi-directional light emitting diode drive circuit (U100);

In addition, the bi-directional light emitting diode drive circuit (U100) can be controlled and driven by means of modulating the output power from the DC to AC inverter (4000), as well as by executing power modulations to the power outputted such as pulse width modulation, or conductive current phase angle control, or impedance modulation, etc;

6. The bi-directional light emitting diode drive circuit (U100) is arranged to be series connected with a least one conventional impedance component (500) and further to be parallel connected with the power source, whereof the impedance (500) includes that:

(1) An impedance component (500): it is constituted by a component with resistive impedance characteristics; or (2) An impedance component (500): it is constituted by a component with inductive impedance characteristics; or (3) An impedance component (500): it is constituted by a component with capacitive impedance characteristics; or (4) An impedance component (500): it is constituted by a single impedance component with the combined impedance characteristics of at least two of the resistive impedance, or inductive impedance, or capacitive impedance simultaneously, thereby to provide DC or AC impedances; or (5) An impedance component (500): it is constituted by a single impedance component with the combined impedance characteristics of inductive impedance and capacitive impedance, whereof its inherent resonance frequency is the same as the frequency or period of bi-directional power, thereby to produce a parallel resonance status; or (6) An impedance component (500): it is constituted by one kind or more than one kind of one or more than ones capacitive impedance component, or inductive impedance component, or resistive impedance component or two kinds or more than two kinds of impedance components in series connection, or parallel connection, or series and parallel connection so as to provide DC or AC impedances; or (7) An impedance component (500): it is constituted by the mutual series connection of a capacitive impedance component and an inductive impedance component, whereof its inherent series resonance frequency is the same as the frequency or period of bi-directional power from power source to produce a series resonance status and the end voltage across two ends of the capacitive impedance component or the inductive impedance component appear in series resonance correspondingly;

Or the capacitive impedance and the inductive impedance are in mutual parallel connection, whereby its inherent parallel resonance frequency is the same as the frequency or period of bi-directional power from power source, thereby to produce a parallel resonance status and appear the corresponding end voltage.

Figure 17:
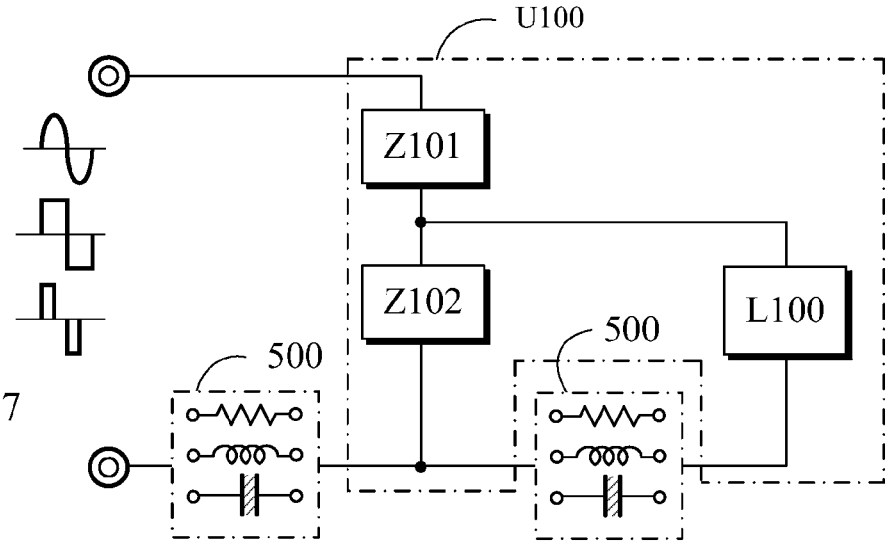
FIG. 17 is a circuit example schematic block diagram of the invention which is series connected with impedance components.
Figure 18:
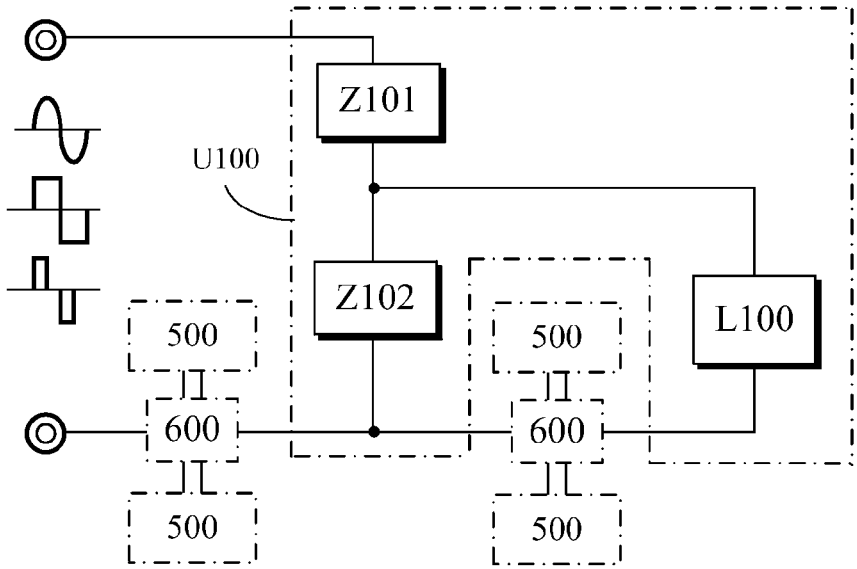
FIG. 18 is a circuit example schematic block diagram of the invention illustrating that the impedance components in series connection execute series connection, or parallel connection, or series and parallel connection by means of the switching device.

FIG. 17 is a circuit example schematic block diagram of the invention which is series connected with impedance components;

7. At least two impedance components (500) as said in the item 6 execute switches between series connection, parallel connection and series and parallel connection bye means of the switching device (600) which is constituted by electromechanical components or solid state components, whereby to modulate the power transmitted to the bi-directional light emitting diode drive circuit (U100), wherein FIG. 18 is a circuit example schematic block diagram of the invention illustrating that the impedance components in series connection execute series connection, or parallel connection, or series and parallel connection by means of the switching device.

Figure 19:
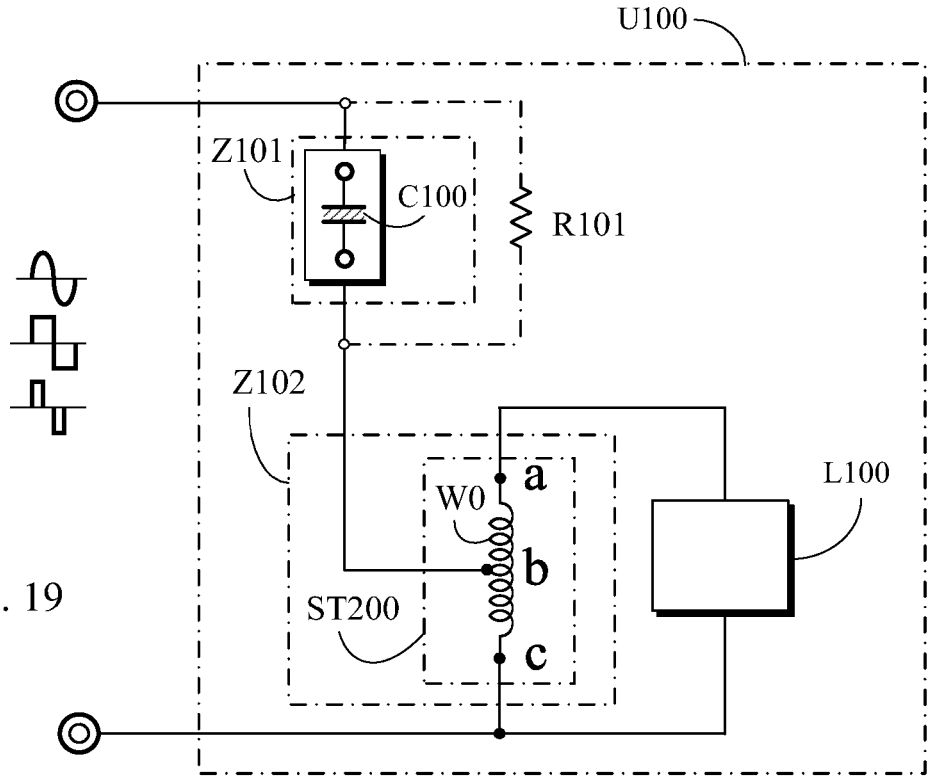
FIG. 19 is a circuit example schematic diagram of the invention illustrating that the inductive impedance component of the second impedance is replaced by the self-coupled voltage change power supply side winding of the self-coupled transformer thereby to constitute a voltage rise.
Figure 20:
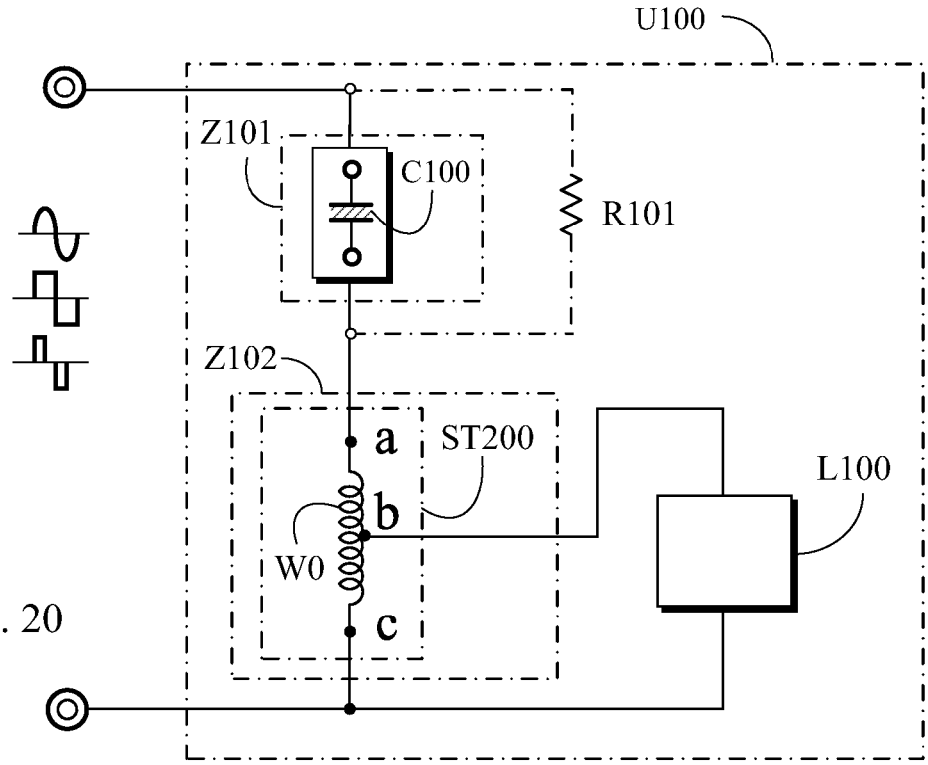
FIG. 20 is a circuit example schematic diagram of the invention illustrating that the inductive impedance component of the second impedance is replaced by the self-coupled voltage change power supply side winding of the self-coupled transformer thereby to constitute a voltage drop.
Figure 21:
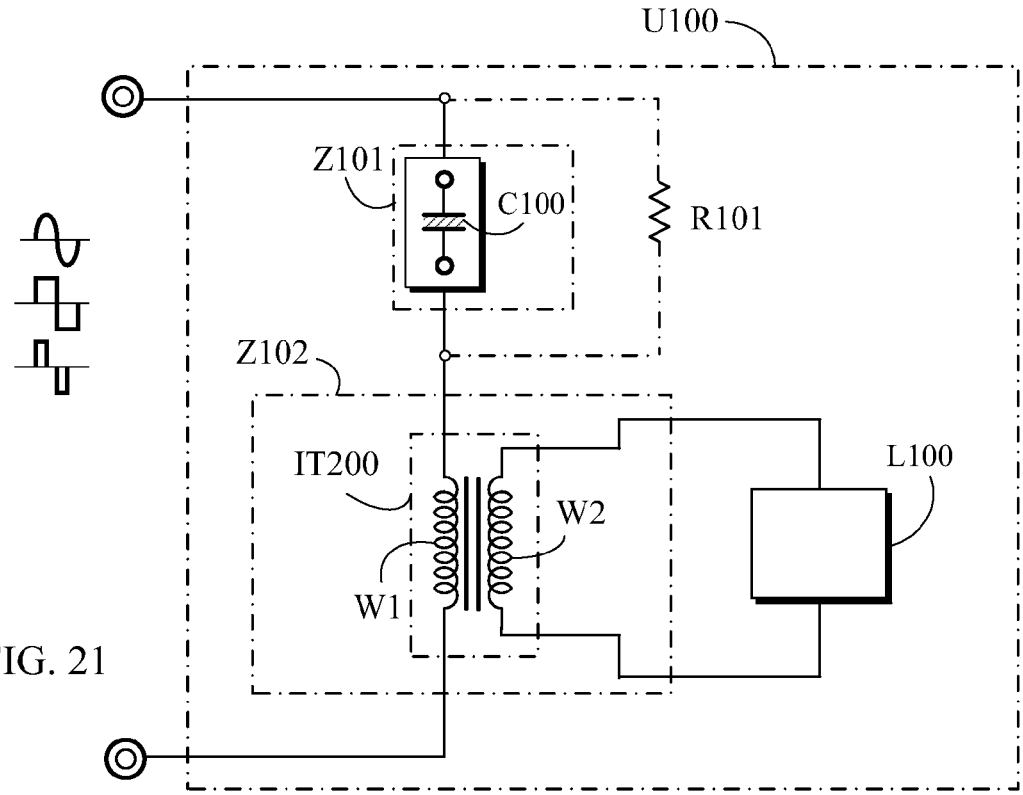
FIG. 21 is a circuit example schematic diagram of the invention illustrating that the inductive impedance component of the second impedance is replaced by the primary side winding of the separating type transformer with separating type voltage change winding.

The bi-directional light emitting diode drive circuit in bi-directional divided power impedance, in which the optionally installed inductive impedance component (I200) of the second impedance (Z102) can be further replaced by the power supply side winding of a transformer with inductive effect, whereof the transformer can be a self-coupled transformer (ST200) with self-coupled voltage change winding or a transformer (IT200) with separating type voltage change winding;

FIG. 19 is a circuit example schematic diagram of the invention illustrating that the inductive impedance component of the second impedance is replaced by the self-coupled voltage change power supply side winding of the self-coupled transformer thereby to constitute a voltage rise, whereof as shown in FIG. 19, the self-coupled transformer (ST200) has a self-coupled voltage change winding (W0) with voltage raising function, the b, c ends of the self-coupled voltage change winding (W0) of the self-coupled transformer (ST200) are the power supply side which replace the inductive impedance component (I200) of the second impedance (Z102), thereby to constitute the second impedance (Z102), whereof the a, c output ends of the self-coupled voltage change winding (W0) of the self-coupled transformer (ST200) are arranged to provide AC power of voltage rise to drive the bi-directional conducting light emitting diode set (L100);

FIG. 20 is a circuit example schematic diagram of the invention illustrating that the inductive impedance component of the second impedance is replaced by the self-coupled voltage change power supply side winding of the self-coupled transformer thereby to constitute a voltage drop, whereof as shown in FIG. 20, the self-coupled transformer (ST200) has a self-coupled voltage change winding (W0) with voltage drop function, in which the b, c ends of the self-coupled voltage change winding (W0) of the self-coupled transformer (ST200) are the power supply side which replace the inductive impedance component (I200) of the second impedance (Z102), thereby to constitute the second impedance (Z102), whereof the a, c output ends of the self-coupled voltage change winding (W0) of the self-coupled transformer (ST200) are arranged to provide AC power of voltage drop to drive the bi-directional conducting light emitting diode set (L100);

FIG. 21 is a circuit example schematic diagram of the invention illustrating that the inductive impedance component of the second impedance is replaced by the primary side winding of the separating type transformer with separating type voltage change winding, whereof as shown in FIG. 21, the separating type transformer (IT200) is comprised of a primary side winding (W1) and a secondary side winding (W2), in which the primary side winding (W1) and the secondary side winding (W2) are separated, while the primary side winding (W1) constitute the second impedance (Z102), whereof the output voltage of the secondary side winding (W2) of the separating type transformer (IT200) can be optionally selected as needed to provide AC power of voltage rise or voltage drop to drive the bi-directional conducting light emitting diode set (L100).

Through the above description, the inductive impedance component (I200) of the second impedance (Z102) is replaced by the power supply side winding of the transformer, whereof the secondary side of the separating type transformer (IT200) provides AC power of voltage rise or voltage drop to drive the bi-directional conducting light emitting diode set (L100).

The bi-directional light emitting diode drive circuit in bi-directional divided power impedance, in which the optionally installed inductive impedance component (I200) of the second impedance (Z102) can be further replaced by the power supply side winding of a transformer with inductive effect thereby to constitute the second impedance (Z102) which is parallel connected with the capacitor (C200) to appear parallel resonance, whereof the transformer can be a self-coupled transformer (ST200) with self-coupled voltage change winding or a transformer (IT200) with separating type voltage change winding.

Figure 22:
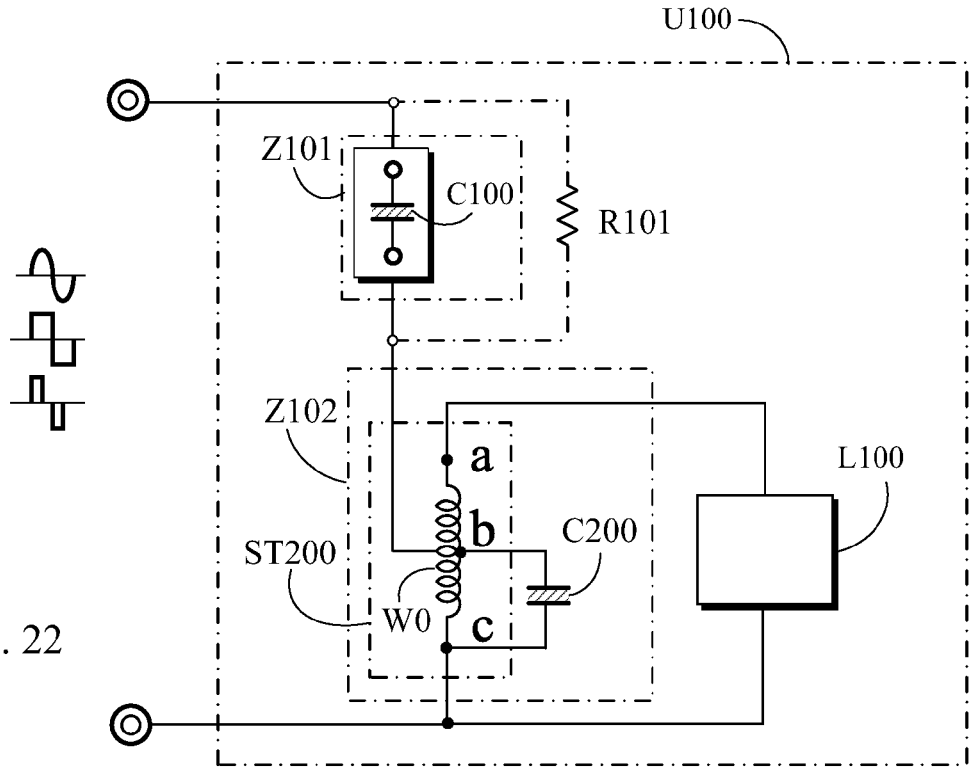
FIG. 22 is a circuit example schematic diagram of the invention illustrating that the self-coupled voltage change power supply side winding of the self-coupled transformer is in parallel resonance with the parallel connected capacitive impedance component to constitute a voltage rise.

FIG. 22 is a circuit example schematic diagram of the invention illustrating that the self-coupled voltage change power supply side winding of the self-coupled transformer is in parallel resonance with the parallel connected capacitor to constitute a voltage rise, whereof as shown in FIG. 22, the self-coupled transformer (ST200) has a self-coupled voltage change winding (W0) with voltage raising function, the b, c ends of the self-coupled voltage change winding (W0) of the self-coupled transformer (ST200) is the power supply side which replace the inductive impedance component (I200) of the second impedance (Z102) to be parallel connected with the capacitor (C200), whereof its inherent parallel resonance frequency after parallel connection is the same as frequency of the bi-directional power from power source such as the AC power, or the alternated polarity period of the constant or variable voltage and constant or variable periodically alternated polarity power converted from DC power to produce a parallel resonance status, thereby to constitute the second impedance (Z102), which is series connected with the capacitor (C100) of the first impedance (Z101); further, the capacitor (C200) can be optionally parallel connected with the a, c taps or b, c taps of the self-coupled transformer (ST200), or other selected taps as needed, whereof the a, c output ends of the self-coupled voltage change winding (W0) of the self-coupled transformer (ST200) are arranged to provide AC power of voltage rise to drive the bi-directional conducting light emitting diode set (L100).

Figure 23:
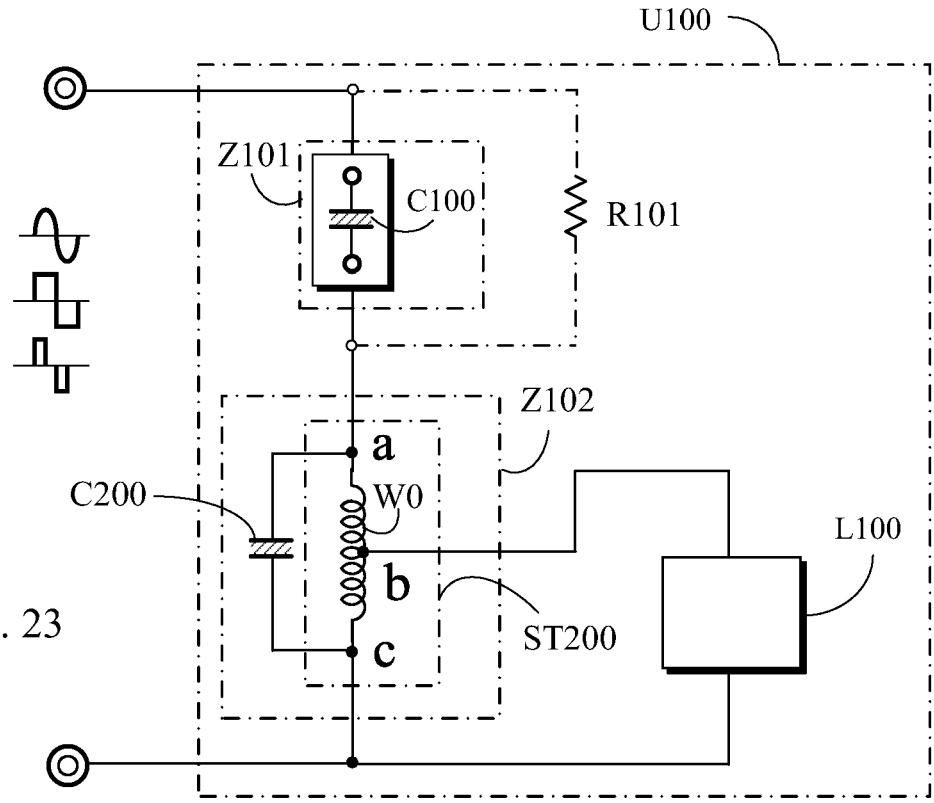
FIG. 23 is a circuit example schematic diagram of the invention illustrating that the self-coupled voltage change power supply side winding of the self-coupled transformer is in parallel resonance with the parallel connected capacitive impedance component to constitute a voltage drop.

FIG. 23 is a circuit example schematic diagram of the invention illustrating that the self-coupled voltage change power supply side winding of the self-coupled transformer is in parallel resonance with the parallel connected capacitor to constitute a voltage drop, whereof as shown in FIG. 23, the self-coupled transformer (ST200) has a self-coupled voltage change winding (W0) with voltage drop function, in which the a, c ends of the self-coupled voltage change winding (W0) of the self-coupled transformer (ST200) are the power supply side which replace the inductive impedance component (I200) of the second impedance (Z102) to be parallel connected with the capacitor (C200), whereof its inherent parallel resonance frequency after parallel connection is the same as frequency of the bi-directional power from power source such as the AC power, or the alternated polarity period of the constant or variable voltage and constant or variable periodically alternated polarity power converted from DC power so as to produce a parallel resonance status, thereby to constitute the second impedance (Z102), which is series connected with the capacitor (C100) of the first impedance (Z101), further, the capacitor (C200) can be optionally parallel connected with the a, c taps or b, c taps of the self-coupled transformer (ST200), or other selected taps as needed, whereof the b, c output ends of the self-coupled voltage change winding (W0) of the self-coupled transformer (ST200) are arranged to provide AC power of voltage drop to drive the bi-directional conducting light emitting diode set (L100).

Figure 24:
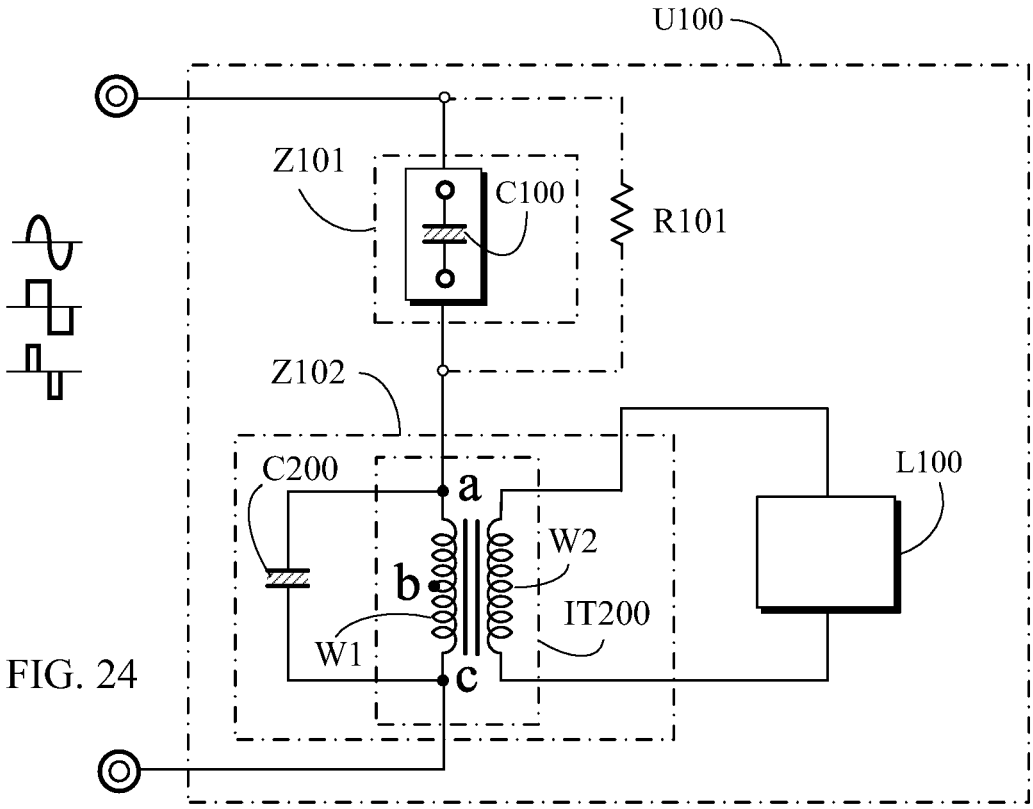
FIG. 24 is a circuit example schematic diagram of the invention illustrating that the primary side winding of the separating type transformer with separating type voltage change winding is parallel connected with a capacitive impedance component to appear a parallel resonance status.

FIG. 24 is a circuit example schematic diagram of the invention illustrating that the primary side winding of the separating type transformer with separating type voltage change winding is parallel connected with a capacitor to appear a parallel resonance status; whereof as shown in FIG. 24, the separating type transformer (IT200) is comprised of a primary side winding (W1) and a secondary side winding (W2), in which the primary side winding (W1) and the secondary side winding (W2) are separated; the primary side winding (W1) is parallel connected with the capacitor (C200), whereof its inherent parallel resonance frequency after parallel connection is the same as frequency of the bi-directional power from power source such as the AC power, or the alternated polarity period of the constant or variable voltage and constant or variable periodically alternated polarity power converted from DC power so as to produce a parallel resonance status, thereby to constitute the second impedance (Z102), which is series connected with the capacitor (C100) of the first impedance (Z101); further, the capacitor (C200) can be optionally parallel connected with the a, c taps or b, c taps of the self-coupled transformer (ST200), or other selected taps as needed, the output voltage of the secondary side winding (W2) of the separating type transformer (IT200) can be optionally selected as needed to be voltage rise or voltage drop, and the AC power output from the secondary side winding is provided to drive the bi-directional conducting light emitting diode set (L100).

Through the above description, the inductive impedance component (I200) of the second impedance (Z102) is replaced by the power supply side winding of the transformer and is parallel connected with the capacitor (C200) to appear parallel resonance, thereby to constitute the second impedance while the secondary side of the separating type transformer (IT200) provides AC power of voltage rise or voltage drop to drive the bi-directional conducting light emitting diode set (L100).

Color of the individual light emitting diodes (LED101), (LED102) of the bi-directional conducting light emitting diode set (L100) in the bi-directional light emitting diode drive circuit (U100) of the bi-directional light emitting diode drive circuit in bi-directional divided power impedance can be optionally selected to be constituted by one or more than one colors.

The relationships of location arrangement between the individual light emitting diodes (LED101) of the bi-directional conducting light emitting diode set (L100) in the bi-directional light emitting diode drive circuit (U100) of the bi-directional light emitting diode drive circuit in bi-directional divided power impedance include the following: 1) sequentially linear arrangement; 2) sequentially distributed in a plane; 3) crisscross-linear arrangement; 4) crisscross distribution in a plane; 5) arrangement based on particular geometric positions in a plane; 6) arrangement based on 3D geometric position.

The bi-directional light emitting diode drive circuit in bi-directional divided power impedance, in which the embodiments of its bi-directional light emitting diode drive circuit (U100) are constituted by circuit components which include: 1) It is constituted by individual circuit components which are inter-connected; 2) At least two circuit components are combined to at least two partial functioning units which are further inter-connected; 3) All components are integrated together to one structure.

As is summarized from above descriptions, progressive performances of power saving, low heat loss and low cost can be provided by the bi-directional light emitting diode drive circuit in bi-directional divided power impedance through the charging/discharging by the uni-polar capacitor to drive light emitting diode.

The invention claimed is:

1. A bi-directional light emitting diode drive circuit in bi-directional divided power impedance, which uses capacitive, or inductive, or resistive impedance components to comprise at least one first impedance, and uses the capacitive, or inductive, or resistive impedance components to comprise at least one second impedance, as well as uses at least one first light emitting diode and at least one second light emitting diode in parallel connection of reverse polarities to comprise at least one bi-directional conducting light emitting diode set which is parallel connected across two ends of the at least one second impedance; two ends of the at least one first impedance and the at least one second impedance in mutual series connection are provided to receive the following:

1) AC power with a constant or variable voltage and a constant or variable frequency; or
2) AC power of bi-directional sinusoidal wave voltage or bi-directional square wave voltage, or bi-directional pulse wave voltage with constant or variable voltage and constant or variable frequency or period which is converted from a DC power source; or
3) AC power of bi-directional sinusoidal wave voltage or bi-directional square wave voltage, or bi-directional pulse wave voltage with constant or variable voltage and constant or variable frequency or period converted from DC power which is further rectified from AC power;

divided power is formed at the first impedance and the second impedance in series connection through the above said powers to drive at least one bi-directional conducting light emitting diode set, or to drive at least two bi-directional conducting light emitting diode sets which are respectively parallel connected across the two ends of the first impedance and the two ends of the second impedance, thereby to comprise the bi-directional light emitting diode drive circuit in bi-directional divided power impedance; wherein:

the first impedance (Z101) is comprised of:

1) one or more than one kinds and one or more than one of the capacitive impedance components or inductive impedance components or resistive impedance components, or two or more than two kinds of impedance components, wherein each kind of impedance components has one or more than one components in series connection or parallel connection, or series and parallel connection; or
2) at least one capacitive impedance component and at least one inductive impedance component in mutual series connection, wherein their frequency is the same as the frequency of the bi-directional power from power source such as the AC power, or the alternated polarity period of a constant or variable voltage and constant or variable periodically alternated polarity power converted from DC power, thereby to appear a series resonance impedance status; or
3) at least one capacitive impedance component and at least one inductive impedance component in mutual parallel connection, wherein their frequency is the same as the frequency of the bi-directional power from power source such as the AC power, or the alternated polarity period of a constant or variable voltage and constant or variable periodically alternated polarity power converted from DC power, thereby to appear a parallel resonance impedance status; or the second impedance (Z102) is comprised of:

1) one or more than one kinds and one or more than one of the capacitive impedance components or inductive impedance components or resistive impedance components, or two or more than two kinds of impedance components, wherein each kind of impedance components has one or more than one components in series connection or parallel connection, or series and parallel connection; or
2) at least one capacitive impedance component and at least one inductive impedance component in mutual series connection, wherein their frequency is the same as the frequency of the bi-directional power from power source such as the AC power, or the alternated polarity period of a constant or variable voltage and constant or variable periodically alternated polarity power converted from DC power, thereby to appear a series resonance impedance status; or
3) at least one capacitive impedance component and at least one inductive impedance component in mutual parallel connection, wherein their frequency is the same as the frequency of the bi-directional power from power source such as the AC power, or the alternated polarity period of a constant or variable voltage and constant or variable periodically alternated polarity power converted from DC power, thereby to appear a parallel resonance impedance status;

the first impedance (Z101) and the second impedance (Z102) are mutually series connected, wherein the two ends of the first impedance (Z101) and the second impedance (Z102) in series connection are provided for:

1) the AC power with a constant or variable voltage and a constant or variable frequency; or
2) the AC power of bi-directional sinusoidal wave voltage or bi-directional square wave voltage, or bi-directional pulse wave voltage with constant or variable voltage and constant or variable frequency or period which is converted from a DC power source; or
3) the AC power of bi-directional sinusoidal wave voltage or bi-directional square wave voltage, or bi-directional pulse wave voltage with constant or variable voltage and constant or variable frequency or period converted from the DC power which is further rectified from an AC power;

a bi-directional conducting light emitting diode set (L100) including at least one first light emitting diode (LED101) and at least one second light emitting diode (LED102) in parallel connection of reverse polarities, wherein the number of first light emitting diodes (LED101) and the number of second light emitting diodes (LED102) can be the same or different, and the first light emitting diode (LED101) and the second light emitting diode (LED102) individually comprise a forward current polarity light emitting diode, or two or more than two forward current polarity light emitting diodes in series connection or parallel connection, or three or more than three forward current polarity light emitting diodes in series connection, parallel connection or series and parallel connection; one or more than one set of the bi-directional conducting light emitting diode set (L100) are parallel connected across the two ends of both or either of the first impedance (Z101) or the second impedance (Z102), wherein the divided power is formed across the two ends of first impedance (Z101) and the two ends of second impedance (Z102) through power input, whereby the bi-directional conducting light emitting diode set (L100) which is parallel connected across the two ends of the first impedance (Z101) or the two ends of the second impedance (Z102) is driven by the said divided power to emit light;

in the bi-directional light emitting diode drive circuit (U100), the first impedance (Z101) and the second impedance (Z102) as well as the bi-directional conducting light emitting diode set (L100) can be selected to be one or more than one as needed;

the first impedance (Z101), the second impedance (Z102) and the bi-directional conducting light emitting diode set (L100) as well as the first light emitting diode (LED101), the second light emitting diode (LED102) and various optional auxiliary circuit components, wherein if more than one are selected, the corresponding polarity relationship shall be determined based on circuit function requirement to execute series connection, or parallel connection or series and parallel connections;

the divided power is formed at the first impedance and the second impedance in series connection through the above said powers to drive at least one bi-directional conducting light emitting diode set, or to drive at least two bi-directional conducting light emitting diode sets which are respectively parallel connected across the two ends of the first impedance and the two ends of the second impedance, thereby to comprise the bi-directional light emitting diode drive circuit in bi-directional divided power impedance, wherein a diode (CR101) is parallel connected with at least one first light emitting diode (LED101) in opposite polarities, and a diode (CR102) is parallel connected with at least one second light emitting diode (LED102) in opposite polarities, whereof the two are further reversely series connected to comprise a bi-directional conducting light emitting diode set.

2. A bi-directional light emitting diode drive circuit in bi-directional divided power impedance as claimed in claim 1, comprising:

the first impedance (Z101) includes at least one capacitive impedance component, especially capacitor (C100), wherein the number of the first impedance can be one or more than one;

the second impedance (Z102) includes at least one capacitive impedance component, especially capacitor (C102), wherein the number of the second impedance can be one or more than one;

the first impedance (Z101) and the second impedance are in series connection, wherein the two ends of them after series connection are provided for:

1) the AC power with a constant or variable voltage and a constant or variable frequency; or 2) the AC power of bi-directional sinusoidal wave voltage or bi-directional square wave voltage, or bi-directional pulse wave voltage with constant or variable voltage and constant or variable frequency or period which is converted from a DC power source; or 3) the AC power of bi-directional sinusoidal wave voltage or bi-directional square wave voltage, or bi-directional pulse wave voltage with constant or variable voltage and constant or variable frequency or period converted from the DC power which is further rectified from an AC power;

the divided power is formed at the first impedance and second impedance in series connection, whereby at least one bi-directional conducting light emitting diode set (L100) is driven by the said divided power;

the bi-directional conducting light emitting diode set (L100) includes at least one first light emitting diode (LED101) and at least one second light emitting diode (LED102) in parallel connection of reverse polarities, wherein the number of the first light emitting diode (LED101) and the number of the second light emitting diode (LED102) can be the same or different, further, the first light emitting diode (LED101) and the second light emitting diode (LED102) individually comprise a forward current polarity light emitting diode; or two or more than two forward current polarity light emitting diodes in series or parallel connections; or three or more than three forward current polarity light emitting diodes in series or parallel connections or in series and parallel connections, wherein it is parallel connected across the two ends of both of or either the first impedance (Z101) or the second impedance (Z102) to form the divided power which is used to drive the bi-directional conducting light emitting diode set (L100) which is parallel connected to the two ends of the first impedance (Z101) or the second impedance (Z102) to emit light; or the bi-directional conducting light emitting diode set (L100) is parallel connected to the two ends of at least one second impedance (Z102), i.e. it is parallel connected across the two ends of the capacitor (C102) which comprise the second impedance (Z102), thereby it is driven by the divided power across the two ends of the capacitor (C102) while the impedance of the first impedance (Z101) is used to limit its current, wherein in case that the capacitor (C100) (such as a bipolar capacitor) is used as the first impedance component, the output current is limited by the capacitive impedance;

the first impedance (Z101), the second impedance (Z102) and the bi-directional conducting light emitting diode set (L100) are connected according to the aforesaid circuit structure to comprise the bi-directional light emitting diode drive circuit (U100).

3. A bi-directional light emitting diode drive circuit in bi-directional divided power impedance as claimed in claim 1, wherein through a current distribution effect formed by the parallel connection of the bi-directional conducting light emitting diode set (L100) and the second impedance (Z102), a voltage variation rate across the two ends of the bi-directional conducting light emitting diode set (L100) corresponding to power source voltage variation can be reduced.

4. A bi-directional light emitting diode drive circuit in bi-directional divided power impedance as claimed in claim 1, wherein either the first light emitting diode (LED101) or the second light emitting diode (LED102) can be replaced by a diode (CR100), wherein the current direction of the said (CR100) and the working current direction of either the first light emitting diode (LED101) or the second light emitting diode (LED102) which is reserved for parallel connection are in parallel connection of reverse polarities.

5. A bi-directional light emitting diode drive circuit in bi-directional divided power impedance as claimed in claim 1, wherein if the first light emitting diode (LED101) and the second light emitting diode (LED102) constituting the bi-directional conducting light emitting diode set (L100) are simultaneously installed with the current limit resistors (R103) and (R104), the current limit resistor (R100) can be directly series connected with the bi-directional conducting light emitting diode set (L100) to replace or installed together with the current limit resistors (R103) and (R104) to obtain the current limit function; or the current limit resistor (R100) can also be replace by an inductive impedance component (I100); the bi-directional light emitting diode drive circuit (U100) thus includes the said circuit structure and selection of auxiliary circuit components.

6. A bi-directional light emitting diode drive circuit in bi-directional divided power impedance as claimed in claim 1, wherein a zener diode can be further parallel connected across the two ends of the first light emitting diode (LED101) and the second light emitting diode (LED102) in the bi-directional conducting light emitting diode set (L100) of the bi-directional light emitting diode drive circuit (U100), or the zener diode is first series connected with at least one diode to produce a zener voltage function, then parallel connected across the two ends of the first light emitting diode (LED101) or of the second light emitting diode (LED102); wherein:

a zener diode (ZD101) is parallel connected across the two ends of the first light emitting diode (LED101) of the bi-directional conducting light emitting diode set (L100), wherein its polarity relationship is that the zener voltage of the zener diode (ZD101) is used to limit the working voltage across the two ends of the first light emitting diode (LED101);

said zener diode (ZD101) series connected with a diode (CR201), wherein the advantages are 1) the zener diode (ZD101) can be protected from reverse current; 2) both diode (CR201) and zener diode (ZD101) have temperature compensation effects;

if the second light emitting diode (LED102) is selected to constitute the bi-directional conducting light emitting diode set (L100), a zener diode (ZD102) can be selected to parallel connect across the two ends of the second light emitting diode (LED102), wherein their polarity relationship is that the zener voltage of the zener diode (ZD102) is used to limit the working voltage across the two ends of the second light emitting diode (LED102);

said zener diode (ZD102) series connected with a diode (CR202) as needed, whereof wherein the advantages are 1) the zener diode (ZD102) can be protected from reverse current; 2) both diode (CR202) and zener diode (ZD102) have temperature compensation effects.

7. A bi-directional light emitting diode drive circuit in bi-directional divided power impedance as claimed in claim 1, wherein the zener diode includes:

1) a zener diode (ZD101) is parallel connected across the two ends of the first light emitting diode (LED101) of the bi-directional conducting light emitting diode set (L100), and a zener diode (ZD102) is parallel connected across the two ends of the second light emitting diode (LED102); or 2) two zener diodes (ZD101) and (ZD102) reversely series connected and are further parallel connected across the two ends of the bi-directional conducting light emitting diode set (L100); or 3) it can be replaced by parallel connecting a diode with bi-directional zener effect in the circuit of bi-directional conducting light emitting diode set (L100); all the above said three circuits can avoid over high end voltage of the first light emitting diode (LED101) and the second light emitting diode (LED102).

8. A bi-directional light emitting diode drive circuit in bi-directional divided power impedance as claimed in claim 1, wherein the first light emitting diode (LED101) can be installed with a charge/discharge device (ESD101), or the second light emitting diode (LED102) can be installed with a charge/discharge device (ESD102), wherein the charge/discharge device (ESD101) and the charge/discharge device (ESD102) have the random charging or discharging characteristics which can stabilize the lighting stability of the first light emitting diode (LED101) and the second light emitting diode (LED102), whereby to reduce their lighting pulsations; the aforesaid charge/discharge devices (ESD101), (ESD102) can include conventional charging and discharging batteries, or super-capacitors or capacitors.

9. A bi-directional light emitting diode drive circuit in bi-directional divided power impedance as claimed in claim 1, wherein the application circuit with the charge/discharge device includes:

the bi-directional light emitting diode drive circuit in bi-directional divided power impedance, wherein in its bi-directional light emitting diode drive circuit (U100), a charge/discharge device (ESD101) can be parallel connected across the two ends of the current limit resistor (R103) and the first light emitting diode (LED101) in series connection;

a charge/discharge device (ESD102) can be further parallel connected across the two ends of the current limit resistor (R104) and the second light emitting diode (LED102) in series connection; wherein:

a charge/discharge device (ESD101) based on its polarity is parallel connected across the two ends of the first light emitting diode (LED101) and the current limit resistor (R103) in series connection, or is directly parallel connected across the two ends of the first light emitting diode (LED101), wherein the charge/discharge device (ESD101) has the random charge/discharge characteristics to stabilize the lighting operation and to reduce the lighting pulsation of the first light emitting diode (LED101);

if the second light emitting diode (LED102) is selected to use, a charge/discharge device (ESD102) based on its polarity is parallel connected across the two ends of the second light emitting diode (LED102) and the current limit resistor (R104) in series connection, wherein the charge/discharge device (ESD102) has the random charge/discharge characteristics to stabilize the lighting operation and to reduce the lighting pulsation of the second light emitting diode (LED102);

aforesaid charge/discharge devices (ESD101), (ESD102) can include conventional charging and discharging batteries, or super-capacitors or capacitors.

10. A bi-directional light emitting diode drive circuit in bi-directional divided power impedance as claimed in claim 1, wherein the application circuit with additionally installed the charge/discharge device includes:

a first light emitting diode (LED101) is selected and is reversely parallel connected with a diode (CR100) in the bi-directional light emitting diode drive circuit (U100), then its main circuit structure is that a charge/discharge device (ESD101) based on its polarity is parallel connected across the two ends of the first light emitting diode (LED101) and the current limit resistor (R103) in series connection, wherein the charge/discharge device (ESD101) has the random charge/discharge characteristics to stabilize the lighting operation and to reduce the lighting pulsation of the first light emitting diode (LED101);

aforesaid charge/discharge devices (ESD101), (ESD102) can include conventional charging and discharging batteries, or super-capacitors or capacitors.

11. A bi-directional light emitting diode drive circuit in bi-directional divided power impedance as claimed in claim 1, wherein the application circuit with additionally installed the charge/discharge device includes:

the bi-directional light emitting diode drive circuit (U100), when the current limit resistor (R100) is selected to replace the current limit resistors (R103), (R104) to serve as the common current limit resistor of the bi-directional conducting light emitting diode set (L100) in the light emitting diode drive circuit (U100), or the current limit resistors (R103), (R104) and (R100) are not installed:

a charge/discharge device (ESD101) is directly parallel connected across the two ends of the first light emitting diode (LED101) of the same polarity, and a charge/discharge device (ESD102) is directly parallel connected across the two ends of the second light emitting diode (LED102) of the same polarity, wherein the charge/discharge devices (ESD101) and (ESD102) has the random charge or discharge characteristics;

aforesaid charge/discharge devices (ESD101), (ESD102) can include conventional charging and discharging batteries, or super-capacitors or capacitors.

12. A bi-directional light emitting diode drive circuit in bi-directional divided power impedance as claimed in claim 1, wherein a charge/discharge device (ESD101) or a charge/discharge device (ESD102) can be further installed across the two ends of the bi-directional conducting light emitting diode set (L100) in the bi-directional light emitting diode drive circuit (U100) for random charging/discharging, thereby besides of stabilizing the lighting stabilities of the first light emitting diode (LED101) and the second light emitting diode (LED102) of the bi-directional conducting light emitting diode set (L100), the charge/discharge device can provide its saving power during a power off to drive at least one of the first light emitting diode (LED101) or the second light emitting diode (LED102) to continue emitting light;

if the charge/discharge devices (ESD101) or (ESD102) used is uni-polar, after the first light emitting diode (LED101) is parallel connected with the uni-polar charge/discharge device (ESD101), a diode (CR101) of forward polarity series connection is installed to prevent reverse voltage from damaging the uni-polar charge/discharge device; wherein after the second light emitting diode (LED102) is parallel connected with the uni-polar charge/discharge device (ESD102), a diode (CR102) of forward polarity series connection is installed to prevent reverse voltage from damaging the uni-polar charge/discharge device;

aforesaid charge/discharge devices (ESD101), (ESD102) can include conventional charging and discharging batteries, or super-capacitors or capacitors.

13. A bi-directional light emitting diode drive circuit in bi-directional divided power impedance as claimed in claim 1, wherein in the bi-directional light emitting diode drive circuit (U100), it can be installed with one bi-directional conducting light emitting diode set (L100) or with more than one bi-directional conducting light emitting diode sets (L100) in series connection, parallel connection or series and parallel connection, wherein if one set or more than one sets are selected to be installed, they can be jointly driven by the divided power of the same second impedance (Z102) or driven individually by the corresponding divided power at each of the multiple second impedances (Z102) which are in series connection or parallel connection.

14. A bi-directional light emitting diode drive circuit in bi-directional divided power impedance as claimed in claim 1, wherein if the charge/discharge device is not installed, then current conduction to light emitting diode is intermittent, whereby referring to the input voltage wave shape and duty cycle of current conduction, the light emitting forward current and the peak of light emitting forward voltage of each light emitting diode in the bi-directional conducting light emitting diode set (L100) can be correspondingly selected for the light emitting diode;

if current conduction to light emitting diode is intermittent, the peak of light emitting forward voltage can be correspondingly selected based on the duty cycle of current conduction as long as the principle of that the peak of light emitting forward voltage does not damage the light emitting diode is followed.

15. A bi-directional light emitting diode drive circuit in bi-directional divided power impedance as claimed in claim 1, wherein if the charge/discharge device is not installed, then based on the value and wave shape of the aforesaid light emitting forward voltage, the corresponding current value and wave shape from the forward voltage vs. forward current ratio are produced; however the peak of light emitting forward current shall follow the principle not to damage the light emitting diode (LED101) or (LED102).

16. A bi-directional light emitting diode drive circuit in bi-directional divided power impedance as claimed in claim 1, wherein it is series connected to the bi-directional power modulator of series connection type, wherein the bi-directional power modulator of series connection type comprises:

a bi-directional power modulator of series connection type (300) the including conventional electromechanical components or solid state power components and related electronic circuit components to modulate the bi-directional power output;

the circuit operating functions are the following:

1) the bi-directional power modulator of series connection type (300) is series connected with the bi-directional light emitting diode drive circuit (U100) to receive the bi-directional power from power source, whereby the bi-directional power is modulated by the bi-directional power modulator of series connection type (300) to execute power modulations such as pulse width modulation or current conduction phase angle control, or impedance modulation to drive the bi-directional light emitting diode drive circuit (U100); or 2) the bi-directional power modulator of series connection type (300) is series connected between the second impedance (Z102) and the bi-directional conducting light emitting diode set (L100) whereby the bi-directional divided power across the two ends of the second impedance (Z102) is modulated by the bi-directional power modulator of series connection type (300) to execute power modulations such as pulse width modulation or current conduction phase angle control, or impedance modulation to drive the bi-directional conducting light emitting diode set (L100).

17. A bi-directional light emitting diode drive circuit in bi-directional divided power impedance as claimed in claim 1, wherein it is parallel connected to a bi-directional power modulator of parallel connection type, wherein the bi-directional power modulator of parallel connection type comprises:

a bi-directional power modulator of parallel connection type (400) including conventional electromechanical components or solid state power components and related electronic circuit components to modulate the bi-directional power output;

the circuit operating functions are the following:

1) the bi-directional power modulator of parallel connection type (400) is installed, wherein its output ends are for parallel connection with the bi-directional light emitting diode drive circuit (U100), while its input ends are provided for receiving the bi-directional power from the power source, whereby the bi-directional power is modulated by the bi-directional power modulator of parallel connection type (400) to execute power modulations such as pulse width modulation or current conduction phase angle control, or impedance modulation to drive the bi-directional light emitting diode drive circuit (U100); or 2) the bi-directional power modulator of parallel connection type (400) is installed, wherein its output ends are parallel connected with the input ends of the bi-directional conducting light emitting diode set (L100) while its input ends are parallel connected with the second impedance (Z102), whereby the bi-directional divided power across the two ends of the second impedance (Z102) is modulated by the bi-directional power modulator of parallel connection type (400) to execute power modulations such as pulse width modulation or current conduction phase angle control, or impedance modulation to drive the bi-directional conducting light emitting diode set (L100).

18. A bi-directional light emitting diode drive circuit in bi-directional divided power impedance as claimed in claim 1, wherein it is driven by the output power of the DC to AC inverter, wherein:

a DC to AC Inverter (4000) including conventional electromechanical components or solid state power components and related electronic circuit components, wherein its input ends are provided as needed to receive input from a constant or variable voltage DC power, or a DC power rectified from an AC power, while its output ends are selected as needed to supply a bi-directional power of bi-directional sinusoidal wave, or bi-directional square wave or bi-directional pulse wave in a constant or variable voltage and constant or variable alternated polarity frequency or period to be used as the power source to supply bi-directional power;

a bi-directional power modulator of series connection type (300) including conventional electromechanical components or solid state power components and related electronic circuit components to modulate the bi-directional power output;

the circuit operating functions are described in the following:

1) the bi-directional power modulator of series connection type (300) is series connect with the bi-directional light emitting diode drive circuit (U100); after the two are in series connection, they are parallel connected with the output ends of the DC to AC inverter (4000), and the bi-directional power output of the DC to AC inverter (4000) is modulated by the bi-directional power modulator of series connection type (300) to execute power modulations such as pulse width modulation or current conduction phase angle control, or impedance modulation to drive the bi-directional light emitting diode drive circuit (U100); or 2) the bi-directional power modulator of series connection type (300) is series connected between the second impedance (Z102) and the bi-directional conducting light emitting diode set (L100), whereby the bi-directional divided power across the two ends of the second impedance (Z102) is used to execute power modulations such as pulse width modulation or current conduction phase angle control, or impedance modulation to drive the bi-directional conducting light emitting diode set (L100).

19. A bi-directional light emitting diode drive circuit in bi-directional divided power impedance as claimed in claim 1, wherein it is driven by the output power of the DC to AC inverter, wherein:

a DC to AC Inverter (4000) including conventional electromechanical components or solid state power components and related electronic circuit components, wherein its input ends are provided as needed to receive input from a constant or variable voltage DC power, or a DC power rectified from an AC power, while its output ends are selected as needed to supply bi-directional power of bi-directional sinusoidal wave, or bi-directional square wave or bi-directional pulse wave in a constant or variable voltage and constant or variable alternated polarity frequency or periods to be used as the power source to supply bi-directional power;

a bi-directional power modulator of parallel connection type (400) including conventional electromechanical components or solid state power components and related electronic circuit components to modulate the bi-directional power output;

the circuit operating functions are described in the following:

1) the bi-directional power modulator of parallel connection type (400) is installed, wherein its output ends are parallel connected with the input ends of the bi-directional light emitting diode drive circuit (U100) and its input ends are provided to receive the bi-directional power output from the DC to AC inverter (4000), whereby the bi-directional power output of the DC to AC invert (4000) is modulated by the bi-directional power modulator of parallel connection type (400) to execute power modulations such as pulse width modulation or current conduction phase angle control, or impedance modulation to drive the bi-directional light emitting diode drive circuit (U100); or 2) the bi-directional power modulator of parallel connection type (400) is installed, wherein its output ends are parallel connected with the input ends of the bi-directional conducting light emitting diode set (L100) while its input ends are parallel connected with the second impedance (Z102), whereby the bi-directional divided power across the two ends of the second impedance (Z102) is modulated by the bi-directional power modulator of parallel connection type (400) to execute power modulations such as pulse width modulation or current conduction phase angle control, or impedance modulation to drive the bi-directional conducting light emitting diode set (L100).

20. A bi-directional light emitting diode drive circuit in bi-directional divided power impedance as claimed in claim 1, wherein it is driven by a DC to AC inverter output power; wherein:

a DC to AC Inverter (4000) including conventional electromechanical components or solid state power components and related electronic circuit components, wherein its input ends are provided as needed to receive input from a constant or variable voltage DC power, or a DC power rectified from an AC power, while its output ends are selected as needed to supply bi-directional power of bi-directional sinusoidal wave, or bi-directional square wave or bi-directional pulse wave in a constant or variable voltage and constant or variable alternated polarity frequency or periods to be used as the power source to supply bi-directional power;

the circuit operating functions are the following:

the bi-directional light emitting diode drive circuit (U100) is parallel connected across the output ends of the conventional DC to AC inverter (4000); the input ends of the DC to AC inverter (4000) are provided as needed to receive input from a constant or variable voltage DC power, or a DC power rectified from an AC power;

the output ends of the DC to AC inverter (4000) can be selected as needed to provide a bi-directional power of bi-directional sinusoidal wave, or bi-directional square wave or bi-directional pulse wave in a fixed or variable voltage and constant or variable polarity frequency or period as the bi-directional power source to control and drive the bi-directional light emitting diode drive circuit (U100);

the bi-directional light emitting diode drive circuit (U100) can be controlled and driven by means of modulating the output power from the DC to AC inverter (4000), as well as by executing power modulations to the power outputted such as pulse width modulation, or conductive current phase angle control, or impedance modulation.

21. A bi-directional light emitting diode drive circuit in bi-directional divided power impedance as claimed in claim 1, wherein the bi-directional light emitting diode drive circuit (U100) is arranged to be series connected with a least one conventional impedance component (500) and further to be parallel connected with the power source, wherein the impedance (500) includes:

1) a component with resistive impedance characteristics; or
2) a component with inductive impedance characteristics; or
3) a component with capacitive impedance characteristics; or
4) a single impedance component with the combined impedance characteristics of at least two of the resistive impedance, or inductive impedance, or capacitive impedance simultaneously, thereby to provide DC or AC impedances; or
5) a single impedance component with the combined impedance characteristics of inductive impedance and capacitive impedance, wherein its inherent resonance frequency is the same as the frequency or period of bi-directional power, thereby to produce a parallel resonance status; or
6) one kind or more than one kind of one or more than ones capacitive impedance component, or inductive impedance component, or resistive impedance component or two kinds or more than two kinds of impedance components in series connection, or parallel connection, or series and parallel connection so as to provide DC or AC impedances; or
7) the mutual series connection of a capacitive impedance component and an inductive impedance component, wherein its inherent series resonance frequency is the same as the frequency or period of bi-directional power from power source to produce a series resonance status and the end voltage across two ends of the capacitive impedance component or the inductive impedance component appear in series resonance correspondingly;

or the capacitive impedance and the inductive impedance are in mutual parallel connection, whereby its inherent parallel resonance frequency is the same as the frequency or period of bi-directional power from power source, thereby to produce a parallel resonance status and appear the corresponding end voltage.

22. A bi-directional light emitting diode drive circuit in bi-directional divided power impedance as claimed in claim 1, wherein the inductive impedance component (I200) of the second impedance (Z102) can be further replaced by the power supply side winding of a transformer with inductive effect, wherein the self-coupled transformer (ST200) has a self-coupled voltage change winding (W0) with voltage raising function, the b, c ends of the self-coupled voltage change winding (W0) of the self-coupled transformer (ST200) are the power supply side which replace the inductive impedance component (I200) of the second impedance (Z102), thereby to constitute comprise the second impedance (Z102), wherein the a, c output ends of the self-coupled voltage change winding (W0) of the self-coupled transformer (ST200) are arranged to provide AC power of voltage rise to drive the bi-directional conducting light emitting diode set (L100).

23. A bi-directional light emitting diode drive circuit in bi-directional divided power impedance as claimed in claim 1, wherein the inductive impedance component (I200) of the second impedance (Z102) can be further replaced by the power supply side winding of a transformer with inductive effect, wherein the self-coupled transformer (ST200) has a self-coupled voltage change winding (W0) with voltage drop function, in which the b, c ends of the self-coupled voltage change winding (W0) of the self-coupled transformer (ST200) are the power supply side which replace the inductive impedance component (I200) of the second impedance (Z102), thereby to comprise the second impedance (Z102), wherein the a, c output ends of the self-coupled voltage change winding (W0) of the self-coupled transformer (ST200) are arranged to provide AC power of voltage drop to drive the bi-directional conducting light emitting diode set (L100).

24. A bi-directional light emitting diode drive circuit in bi-directional divided power impedance as claimed in claim 1, wherein the inductive impedance component (I200) of the second impedance (Z102) can be further replaced by the power supply side winding of a transformer with inductive effect, wherein the separating type transformer (IT200) is comprised of a primary side winding (W1) and a secondary side winding (W2), in which the primary side winding (W1) and the secondary side winding (W2) are separated, while the primary side winding (W1) comprise the second impedance (Z102), wherein the output voltage of the secondary side winding (W2) of the separating type transformer (IT200) can be optionally selected as needed to provide AC power of voltage rise or voltage drop to drive the bi-directional conducting light emitting diode set (L100);

the inductive impedance component (I200) of the second impedance (Z102) is replaced by the power supply side winding of the transformer, wherein the secondary side of the separating type transformer (IT200) provides AC power of voltage rise or voltage drop to drive the bi-directional conducting light emitting diode set (L100).

25. A bi-directional light emitting diode drive circuit in bi-directional divided power impedance as claimed in claim 1, wherein the inductive impedance component (I200) of the second impedance (Z102) can be further replaced by the power supply side winding of a transformer with inductive effect, wherein the self-coupled transformer (ST200) has a self-coupled voltage change winding (W0) with voltage raising function, the b, c ends of the self-coupled voltage change winding (W0) of the self-coupled transformer (ST200) is the power supply side which replace the inductive impedance component (I200) of the second impedance (Z102) to be parallel connected with the capacitor (C200), wherein its inherent parallel resonance frequency after parallel connection is the same as frequency of the bi-directional power from power source such as the AC power, or the alternated polarity period of the constant or variable voltage and constant or variable periodically alternated polarity power converted from DC power to produce a parallel resonance status, thereby to comprise the second impedance (Z102), which is series connected with the capacitor (C100) of the first impedance (Z101); further, the capacitor (C200) can be parallel connected with the a, c taps or b, c taps of the self-coupled transformer (ST200), or other selected taps as needed, wherein the a, c output ends of the self-coupled voltage change winding (W0) of the self-coupled transformer (ST200) are arranged to provide AC power of voltage rise to drive the bi-directional conducting light emitting diode set (L100).

26. A bi-directional light emitting diode drive circuit in bi-directional divided power impedance as claimed in claim 1, wherein the installed inductive impedance component (I200) of the second impedance (Z102) can be further replaced by the power supply side winding of a transformer with inductive effect, wherein the self-coupled transformer (ST200) has a self-coupled voltage change winding (W0) with voltage drop function, in which the a, c ends of the self-coupled voltage change winding (W0) of the self-coupled transformer (ST200) are the power supply side which replace the inductive impedance component (I200) of the second impedance (Z102) to be parallel connected with the capacitor (C200), wherein its inherent parallel resonance frequency after parallel connection is the same as frequency of the bi-directional power from power source such as the AC power, or the alternated polarity period of the constant or variable voltage and constant or variable periodically alternated polarity power converted from DC power so as to produce a parallel resonance status, thereby to comprise the second impedance (Z102), which is series connected with the capacitor (C100) of the first impedance (Z101), further, the capacitor (C200) can be parallel connected with the a, c taps or b, c taps of the self-coupled transformer (ST200), or other selected taps as needed, wherein the b, c output ends of the self-coupled voltage change winding (W0) of the self-coupled transformer (ST200) are arranged to provide AC power of voltage drop to drive the bi-directional conducting light emitting diode set (L100).

27. A bi-directional light emitting diode drive circuit in bi-directional divided power impedance as claimed in claim 1, wherein the inductive impedance component (I200) of the second impedance (Z102) can be further replaced by the power supply side winding of a transformer with inductive effect, wherein the separating type transformer (IT200) is comprised of a primary side winding (W1) and a secondary side winding (W2), in which the primary side winding (W1) and the secondary side winding (W2) are separated; the primary side winding (W1) is parallel connected with the capacitor (C200), wherein its inherent parallel resonance frequency after parallel connection is the same as frequency of the bi-directional power from power source such as the AC power, or the alternated polarity period of the constant or variable voltage and constant or variable periodically alternated polarity power converted from DC power so as to produce a parallel resonance status, thereby to comprise the second impedance (Z102), which is series connected with the capacitor (C100) of the first impedance (Z101); further, the capacitor (C200) can be parallel connected with the a, c taps or b, c taps of the self-coupled transformer (ST200), or other selected taps as needed, the output voltage of the secondary side winding (W2) of the separating type transformer (IT200) can be selected as needed to be voltage rise or voltage drop, and the AC power output from the secondary side winding is provided to drive the bi-directional conducting light emitting diode set (L100);

the inductive impedance component (I200) of the second impedance (Z102) is replaced by the power supply side winding of the transformer and is parallel connected with the capacitor (C200) to appear parallel resonance, thereby to comprise the second impedance while the secondary side of the separating type transformer (IT200) provides AC power of voltage rise or voltage drop to drive the bi-directional conducting light emitting diode set (L100).

* * * * *